US011674338B2

(12) United States Patent
Tomaszewski

(10) Patent No.: US 11,674,338 B2
(45) Date of Patent: Jun. 13, 2023

(54) AUTOMOTIVE DOOR LATCH WITH POWER OPENING FEATURE

(71) Applicant: MAGNA CLOSURES INC., Newmarket (CA)

(72) Inventor: Kris Tomaszewski, Newmarket (CA)

(73) Assignee: MAGNA CLOSURES INC., Newmarket (CA)

( * ) Notice: Subject to any disclaimer, the term of this patent is extended or adjusted under 35 U.S.C. 154(b) by 1115 days.

(21) Appl. No.: 16/362,736

(22) Filed: Mar. 25, 2019

(65) Prior Publication Data

US 2019/0292817 A1 Sep. 26, 2019

Related U.S. Application Data

(60) Provisional application No. 62/648,014, filed on Mar. 26, 2018.

(51) Int. Cl.
*E05B 81/20* (2014.01)
*E05B 81/68* (2014.01)
(Continued)

(52) U.S. Cl.
CPC ..... *E05B 81/20* (2013.01); *E05B 79/20* (2013.01); *E05B 81/56* (2013.01); *E05B 81/68* (2013.01);
(Continued)

(58) Field of Classification Search
CPC ..... E05B 81/00; E05B 81/02; E05B 81/04; E05B 81/05; E05B 81/12; E05B 81/20;
(Continued)

(56) References Cited

U.S. PATENT DOCUMENTS 1,869,274 A 7/1932 Phillips
3,998,482 A 12/1976 Nozaki et al.
(Continued)

FOREIGN PATENT DOCUMENTS

CN 106004375 A 10/2016
CN 107762298 A 3/2018
(Continued)

OTHER PUBLICATIONS

Computer Generated Translation for FR 2726849 A1, https://worldwide.espacenet.com/, Generated on May 18, 2022 (Year: 2022).*

*Primary Examiner* — Alyson M Merlino
(74) *Attorney, Agent, or Firm* — Dickinson Wright PLLC

(57) ABSTRACT

A power-operated vehicle closure system includes a vehicle door equipped with a cinch assembly having a power actuator and a closure latch assembly having a latch mechanism and a latch cinch mechanism. Actuation of the power actuator in a first direction provides a power cinch operation to cause the latch cinch mechanism to cinch the latch mechanism. Actuation of the power actuator in a second direction provides a power ice breaking operation to cause the latch cinch mechanism to open the latch mechanism. The system includes a controller that receives signals indicating the positions of a ratchet and a pawl of the latch mechanism and controls the power actuator to operate the latch cinch mechanism in either the first or second direction.

17 Claims, 16 Drawing Sheets

(51) Int. Cl.
*E05B 79/20* (2014.01)
*E05B 83/36* (2014.01)
*E05B 81/56* (2014.01)

(52) U.S. Cl.
CPC ..... *E05B 83/36* (2013.01); *E05Y 2900/132* (2013.01)

(58) Field of Classification Search
CPC ..... E05B 81/24; E05B 81/25; E05B 81/26; E05B 81/28; E05B 81/32; E05B 81/42; E05B 81/54; E05B 81/64; E05B 81/66; E05B 81/68; E05B 81/56; E05B 83/36; Y10T 292/1047; Y10T 292/1082; Y10S 292/23; Y10S 292/25; Y10S 292/43
See application file for complete search history.

(56) References Cited

U.S. PATENT DOCUMENTS 4,927,204 A * 5/1990 Asada ..... E05B 81/20 292/216
4,986,579 A 1/1991 Ishikawa
5,466,021 A 11/1995 Ishihara et al.
5,516,164 A 5/1996 Kobayashi
5,639,130 A * 6/1997 Rogers, Jr. ..... E05B 81/20 292/201
5,944,367 A 8/1999 Imaizumi et al.
6,123,372 A * 9/2000 Rogers, Jr. ..... E05B 79/20 292/201
6,505,867 B1 * 1/2003 Szablewski ..... E05B 81/20 292/201
6,550,825 B2 * 4/2003 Ostrowski ..... E05B 81/20 292/201
6,964,440 B2 11/2005 Lebsack et al.
7,261,334 B2 * 8/2007 Oberheide ..... E05B 81/20 292/216
7,627,986 B2 12/2009 Hirai et al.
7,731,000 B2 6/2010 Oh et al.
9,353,556 B2 5/2016 Margheritti et al.
10,590,682 B2 3/2020 Chevalier
11,199,031 B2 12/2021 Wirths
2002/0117862 A1 * 8/2002 Yamauchi ..... E05B 81/20 292/216
2004/0227357 A1 * 11/2004 Ishihara ..... E05B 79/20 292/216
2012/0299313 A1 * 11/2012 Organek ..... E05B 81/06 292/129
2014/0091581 A1 4/2014 Taurasi et al.
2017/0267073 A1 9/2017 Lovelace et al.
2017/0314297 A1 11/2017 Taurasi et al.
2018/0016821 A1 1/2018 Cumbo et al.
2018/0171677 A1 6/2018 Im et al.

FOREIGN PATENT DOCUMENTS

DE 19533196 A1 3/1997
DE 19535065 A1 3/1997
DE 19804516 A1 8/1999
DE 19854790 A1 5/2000
DE 10065569 A1 7/2001
DE 10114065 A1 11/2002
DE 10242830 A1 * 12/2003 ..... E05B 81/06
DE 10242830 A1 12/2003
DE 102004063239 A1 1/2006
DE 202008012706 U1 12/2008
DE 202008012707 U1 12/2008
DE 202008012086 U1 1/2009
DE 102007056653 A1 5/2009
DE 102014003737 A1 9/2015
DE 102016103647 A1 9/2017
EP 1790803 A2 5/2007
EP 2060711 A2 5/2009
EP 2373860 A1 10/2011
FR 2726849 A1 * 5/1996 ..... E05B 81/20
FR 2917049 A1 12/2008
GB 792386 A 3/1958
KR 101199223 B1 11/2012
WO WO-0049252 A1 * 8/2000 ..... E05B 81/20
WO 2011015497 A1 2/2011
WO WO-2011052540 A1 * 5/2011 ..... E05B 81/14

* cited by examiner

AUTOMOTIVE DOOR LATCH WITH POWER OPENING FEATURE

CROSS-REFERENCE TO RELATED APPLICATION

This application claims the benefit of U.S. Provisional Application Ser. No. 62/648,014, filed Mar. 26, 2018, which is incorporated herein by reference in its entirety.

FIELD

The present disclosure relates generally to power-operated vehicle closure systems for use in motor vehicles. More particularly, the present disclosure relates to a power-operated vehicle closure system including a vehicle door equipped with cinch assembly and a closure latch assembly having a power-operated cinch mechanism and which are operatively arranged to provide a power cinching feature and a power opening feature.

BACKGROUND

This section provides background information related to power-operated vehicle closure systems of the type used in motor vehicles that is not necessarily prior art to the inventive concepts associated with the present disclosure.

In view of growing consumer demand for motor vehicles providing advanced comfort and convenience features, many current motor vehicles are now equipped with passive keyless entry systems to permit locking, releasing and opening of closure panels (i.e., swing-type and sliding-type passenger doors, tailgates, liftgates, decklids, etc.). In this regard, some of the more popular features now provided in association with such power-operated vehicle closure systems include power locking/unlocking, power release, power cinching and power opening/closing functionality. Most of these "powered" features are typically integrated into a closure latch assembly mounted to the closure panel, with the features configured to function in association with a latch mechanism, a latch release mechanism, a latch cinch mechanism, and at least one power-operated (i.e. electric) actuator.

As is well known, movement of the closure panel from an open position towards a fully-closed position causes the latch mechanism to engage a striker (mounted to the vehicle body) and shift the closure latch assembly from an unlatched mode into at least one of a secondary latched mode when the closure panel is moved to a partially-closed position and a primary latched mode when the closure panel is moved to its fully-closed position. To "cinch" the closure panel from its partially-closed position into its fully-closed position, a power cinch actuator actuates the latch cinch mechanism to mechanically engage the latch mechanism and cause the closure latch assembly to shift from its secondary latched mode into its primary latched mode, thereby providing the power cinching operation. To release the closure panel from either of its partially-closed and fully-closed positions, a power release actuator actuates the latch release mechanism to mechanically release the striker from the latch mechanism and cause the closure latch assembly to shift into its unlatched mode, thereby providing the power release operation. In most power-operated vehicle closure systems providing the power opening/closing feature, a distinct power-operated presenter device is actuated, in coordination with operation of the closure latch assembly, to move the closure panel between its fully-closed position and at least one of a partially-open (i.e. presentment) position and its fully-open position. Most commonly, this power opening/closing feature is associated with sliding-type passenger doors in mini-vans, but has recently found more application in higher-end vehicles with swing-type passenger doors.

One recognized problem with powered passenger doors is the need to overcome "frozen" door situation. Normally, upon power release of the latch mechanism in the closure latch assembly, the compressive load exerted by the resilient weather seal on the door functions to move the striker out of latched engagement with the latch mechanism. However, if the door and/or the latch mechanism is frozen, such as due to freezing rain or snow, the seal loads are not sufficient to completely release the striker from latched engagement with the latch mechanism, thereby preventing movement of the door (manually or powered) toward its open position. To address and overcome this undesirable frozen door issue, it is known to integrate a separate power-operated opener or "ice breaker" device into the closure latch assembly to forcibly break the door free from its frozen condition. Unfortunately, such an additional ice breaker device detrimentally impacts the overall cost and complexity of the closure latch assembly.

In view of the above, there remains a need to develop alternative closure latch assemblies which address and overcome limitations associated with known latching devices, such as the shortcomings mentioned above, and to advance the art while providing increased applicability while also reducing cost and complexity.

SUMMARY

This section provides a general summary of the disclosure and is not intended to be a comprehensive listing of all aspects, objectives, features and advantages associated with the inventive concepts described and illustrated in the detailed description provided herein.

It is an aspect of the present disclosure to provide a power-operated closure system for a motor vehicle configured to provide a power cinching feature and a power opening or "ice breaking" feature.

It is a related aspect of the present disclosure to provide a power-operated mechanism configured to provide both the power cinching feature and the power ice breaking feature. The power-operated mechanism is operable when driven in a first direction to provide the power cinching feature and is operable when driven in a second direction to provide the power ice breaking feature.

It is yet another related aspect of the present disclosure to configure the power-actuated mechanism as a latch cinch mechanism installed in a closure latch assembly to provide the bi-directional power cinching and power ice breaking features.

It is a further related aspect of the present disclosure to provide a cinch assembly having a power actuator configured to selectively actuate the bi-directional latch cinch mechanism.

In yet another related aspect of the present disclosure, the closure latch assembly and the cinch assembly are both installed within a door of a motor vehicle and arranged with a cable assembly operatively interconnecting the power actuator of the cinch assembly to the latch cinch mechanism of the closure latch assembly.

In accordance with these and other aspects, the present disclosure is directed to a power-operated vehicle closure system including a vehicle door equipped with a cinch assembly having a power actuator and a closure latch assembly having a latch mechanism and a latch cinch mechanism. Actuation of the power actuator in a first direction provides a power cinching operation for causing the latch cinch mechanism to engage and cinch the latch mechanism. Actuation of the power actuator in a second direction provides a power opening operation for causing the latch cinch mechanism to engage and open the latch mechanism. Accordingly, a bi-directional latch cinch mechanism, actuated by a power actuator, provides the dual functions of power cinching and power opening of the closure latch assembly.

In accordance with one non-limiting embodiment, the power-operated vehicle closure system comprises: a door moveable with respect to a vehicle body between an open position and a fully-closed position, a closure latch assembly mounted to the door and having a latch mechanism and a latch cinch mechanism, and a cinch assembly mounted to the door and having a power actuator operatively connected to the latch cinch mechanism, wherein actuation of the power actuator in a first direction functions to cause the latch cinch mechanism to cinch the latch mechanism and actuation in a second direction functions to open the latch mechanism.

In the power-operated vehicle closure system of the present disclosure, the latch mechanism associated with the closure latch assembly comprises: a ratchet moveable between a striker release position whereat the ratchet is positioned to release a striker mounted to the vehicle body and two distinct striker capture positions whereat the ratchet is positioned to retain the striker, wherein the two distinct striker capture positions include a secondary striker capture position when the door is located in a partially-closed position and a primary striker capture position when the door is located in its fully-closed position, a ratchet biasing member for normally biasing the ratchet toward its striker release position, a pawl moveable between a ratchet holding position whereat the pawl is positioned to hold the ratchet in its primary striker capture position and a ratchet releasing position whereat the pawl is located to permit the movement of ratchet to its striker release position, and a pawl biasing member for normally biasing the pawl toward its ratchet holding position.

In the power-operated vehicle closure system of the present disclosure, the latch cinch mechanism includes a rotatable ratchet lever having a cinch cam and an ice breaker cam, wherein actuation of the power actuator in the first direction causes rotation of the ratchet lever in a cinching direction for causing the cinch cam to engage the ratchet and forcibly rotate the ratchet from its secondary striker capture position into its primary striker capture position to provide a power cinch function.

In the power-operated closure system of the present disclosure, actuation of the power actuator in the second direction causes rotation of the ratchet lever in an opening direction for causing the ice breaker cam to engage the ratchet and forcibly rotate the ratchet from its primary striker capture position to its striker release position to provide a power opening function.

In the power-operated closure system of the present disclosure, the ratchet lever is rotatable in the cinching direction from a rest position to a cinch-actuated position to provide the power cinch function, and wherein the ratchet lever is rotatable in the opening direction from the rest position to an ice break-actuated position to provide the power opening function.

In the power-operated closure system of the present disclosure, the power actuator is operable to rotate the ratchet lever from its cinch-actuated position to its rest position upon completion of the power cinch function, and wherein the power actuator is operable to rotate the ratchet lever from its ice breaker-actuated position to its rest position upon completion of the power opening function.

In the power-operated closure system of the present disclosure, the ratchet lever is fixed for rotation to a driven pulley, wherein the cinch assembly includes a drive pulley that is rotatably driven by the power actuator, and wherein a cable assembly interconnects the driven pulley to the drive pulley.

In another aspect, a method for operating a power door for a motor vehicle closure system is provided. The method includes providing a closure latch assembly mounted to the door, the closure latch assembly having a latch mechanism and a latch cinch mechanism; providing a cinch assembly mounted to the door, the cinch assembly having a power actuator operatively connected to the latch cinch mechanism; actuating the power actuator in a first direction and, in response thereto, operating the latch cinch mechanism and cinching the latch mechanism; and actuating the power actuator in a second direction and, in response thereto, operating the latch cinch mechanism and opening the latch mechanism.

In yet another aspect, a system for operating a motor vehicle closure system is provided, the system includes a closure latch assembly having a latch mechanism and a latch cinch mechanism; the latch mechanism including a ratchet moveable in a first direction from a striker release position, to a secondary striker capture position, and to a primary striker capture position, and moveable in a second direction opposite the first direction; the latch mechanism including a pawl moveable between a ratchet holding position and a ratchet releasing position; the latch cinch mechanism operable in a first direction causing movement of the ratchet in its first direction; and the latch cinch mechanism operable in a second direction causing movement of the ratchet in its second direction.

In yet another aspect, there is provided a closure latch assembly with a latch mechanism including a ratchet moveable in a first direction from a striker release position, to a secondary striker capture position, and to a primary striker capture position, and moveable in a second direction opposite the first direction, and the latch mechanism also including a pawl moveable between a ratchet holding position and a ratchet releasing position, and a latch cinch mechanism operable in a first direction causing movement of the ratchet in its first direction and operable in a second direction causing movement of the ratchet in its second direction.

Further areas of applicability will become apparent from the detailed description provided herein. The description and specific examples and embodiments in this summary are intended for purposes of illustration only and are not intended to limit the scope of the present disclosure.

BRIEF DESCRIPTION OF THE DRAWINGS

The drawings described herein are for illustrative purposes only of selected embodiment(s) and not all possible implementations such that the drawings are not intended to limit the scope of the present disclosure. The foregoing and other aspects will now be described by way of example only with reference to the accompanying drawings, in which:

FIG. 2A is plan view of a door module associated with the swing-type passenger door shown in FIG. 1, while

Corresponding reference numbers are used throughout the various views of the drawings to indicate corresponding components.

DETAILED DESCRIPTION

One or more example embodiments of a power-operated closure system for a motor vehicle will now be described more fully with reference to the accompanying drawings. To this end, the example embodiment(s) of such a power-operated closure system having a passenger door equipped with a closure latch assembly and a cinch assembly is provided so that this disclosure will be thorough, and will fully convey its intended scope to those who are skilled in the art. Accordingly, numerous specific details are set forth such as examples of specific components, devices, and methods, to provide a thorough understanding of the embodiment of the present disclosure. However, it will be apparent to those skilled in the art that specific details need not be employed, that example embodiments may be embodied in many different forms, and that neither should be construed to limit the scope of the present disclosure. In some parts of the example embodiment, well-known processes, well-known device structures, and well-known technologies are not described in detail.

In the following detailed description, the expression "closure latch assembly" will be used to generally indicate any power-operated latch device adapted for use with a vehicle closure panel to provide a power cinching feature with or without a power release feature. Furthermore, the expression "cinch assembly" will be used generally to indicate any power-operated cinch device adapted for use in cooperation with the closure latch assembly to provide the power cinching feature. Additionally, the expression "closure panel" will be used to indicate any element moveable between an open position and at least one closed position, respectively opening and closing an access to an inner compartment of a motor vehicle and therefore includes, without limitations, decklids, tailgates, liftgates, bonnet lids, and sunroofs in addition to the sliding and pivoting side passenger doors of a motor vehicle to which the following description will make explicit reference, purely by way of example.

Figure 1:
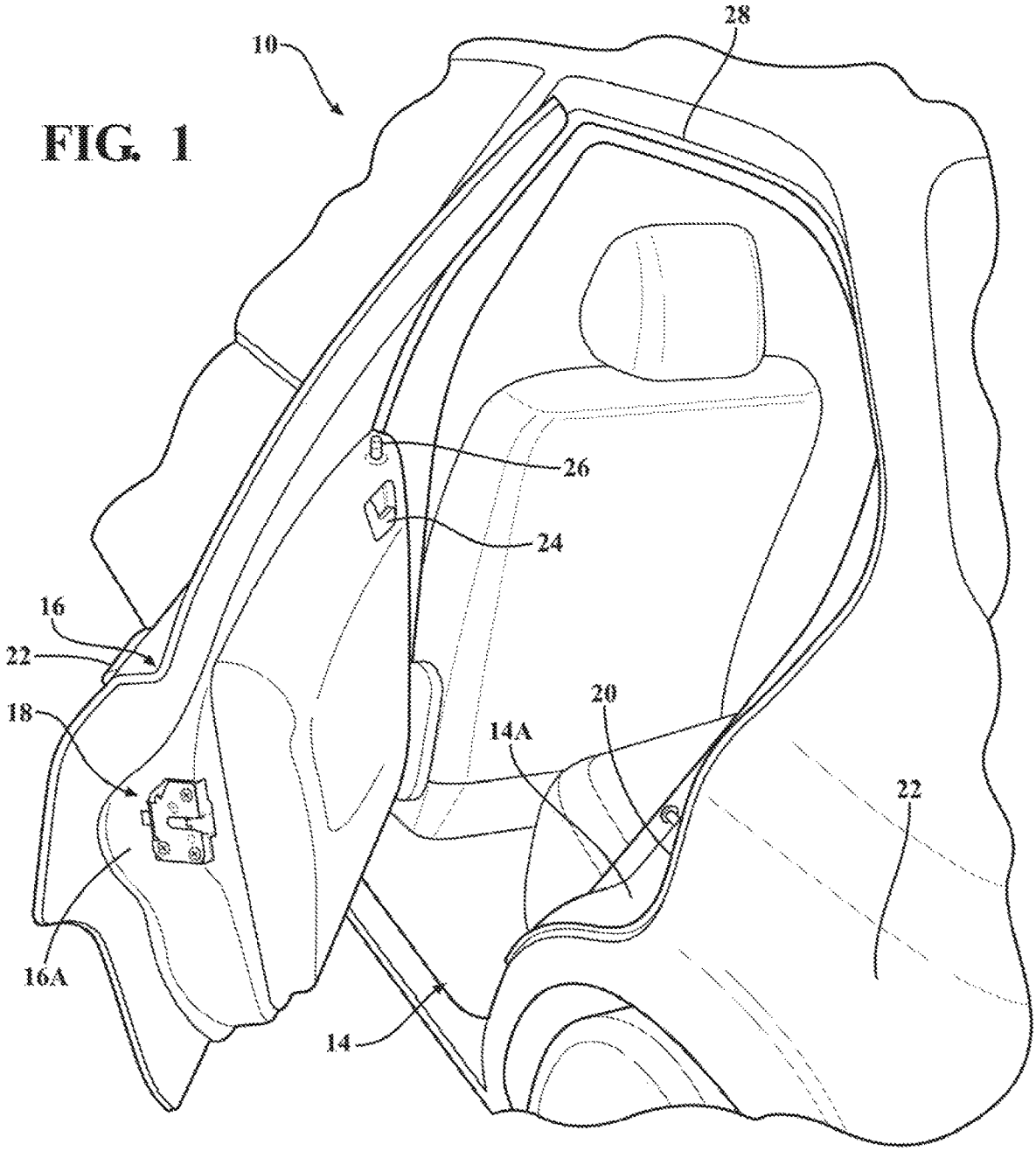
FIG. 1 is a partial isometric view of a motor vehicle equipped with a passenger door having a closure latch assembly and a cinch assembly configured to provide a power cinching feature and a power opening or "ice breaking" feature in accordance with the teachings of the present disclosure.

Referring initially to FIG. 1 of the drawings, a motor vehicle 10 is shown to include a vehicle body 12 defining an opening 14 to an interior passenger compartment. A closure panel 16 is pivotably mounted to body 12 for movement between an open position (shown) and a fully-closed position to respectively open and close opening 14. A closure latch assembly 18 is rigidly secured to closure panel 16 adjacent to an edge portion 16A thereof and is releasably engageable with a striker 20 that is fixedly secured to a recessed edge portion 14A of opening 14. Latch assembly 18 may be for example provided as a single pawl configuration for example as described in U.S. Pat. No. 9,353,556, the entire contents of which are incorporated by reference and may be a double-pawl configuration as shown in US20180016821, the entire contents of which are incorporated by reference. As will be detailed, closure latch assembly 18 is operable to engage striker 20 in response to movement of closure panel 16 toward its fully-closed position. An outside handle 22 and an inside handle 24 are provided for actuating closure latch assembly 18 so as to release striker 20 and permit subsequent movement of closure panel 16 toward its open position. An optional lock knob 26 is shown which provides a visual indication of the locked state of closure latch assembly 18 and which may also be operable to mechanically change the locked state of closure latch assembly 18. A weather seal 28 is mounted on edge portion 14A of opening 14 in vehicle body 12 and is adapted to be resiliently compressed upon engagement with a mating sealing surface of closure panel 16 when closure panel 16 is held by closure latch assembly 18 in its fully-closed position so as to provide a sealed interface therebetween which is configured to prevent entry of rain and dirt into the passenger compartment while minimizing audible wind noise.

Figure 2A:
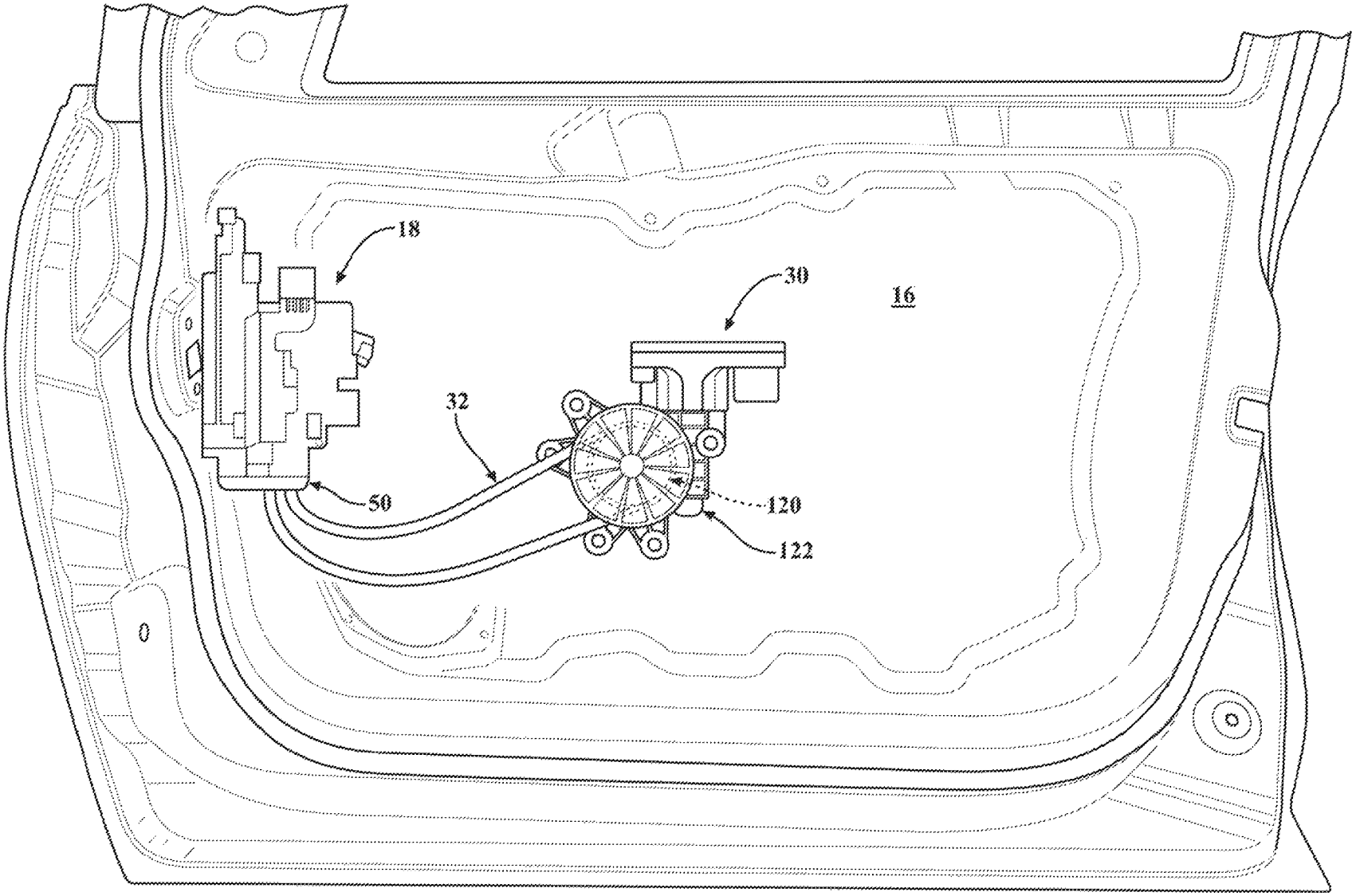
Figure 2B:
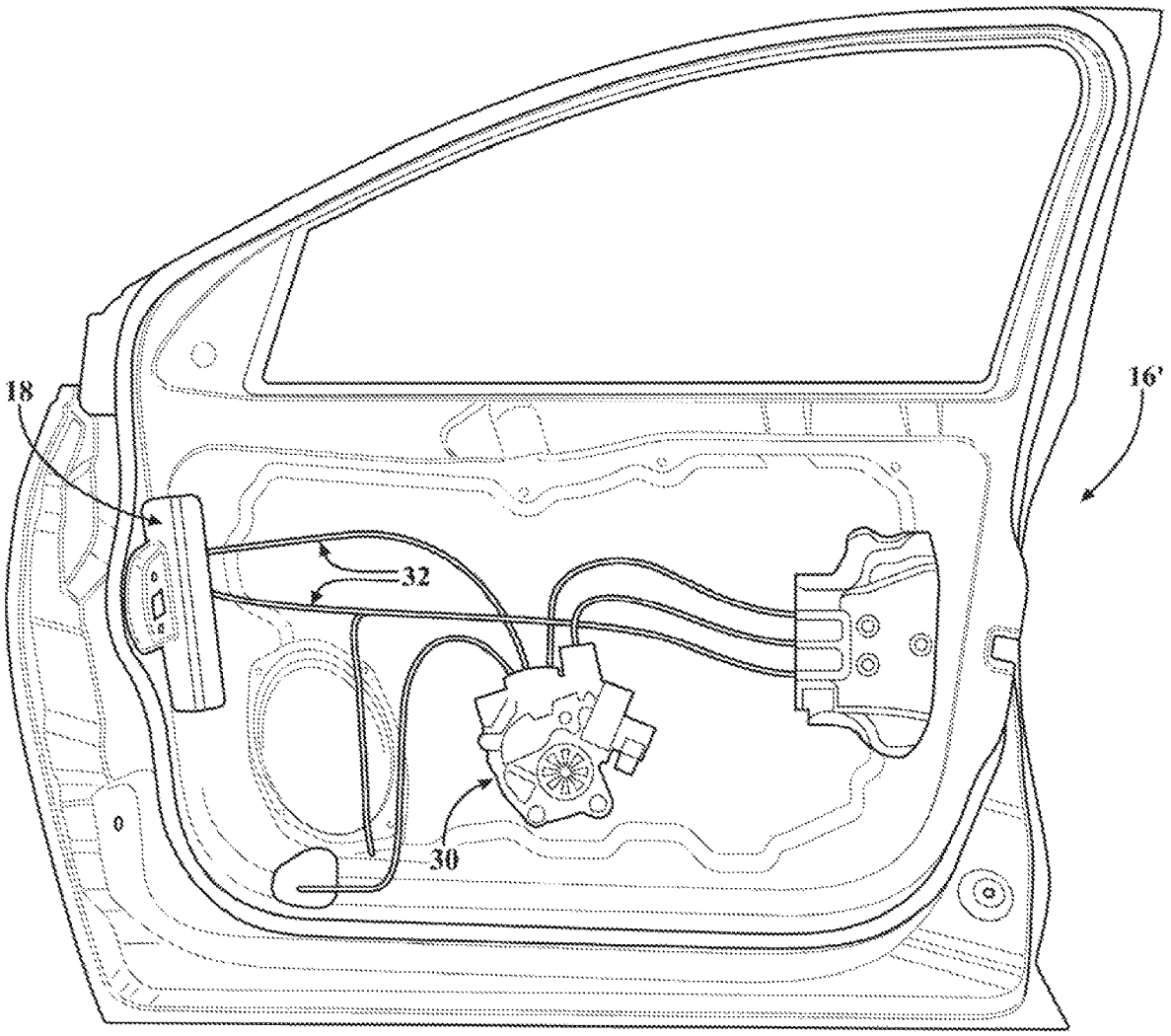
FIG. 2B is a plan view of a door module associated with a sliding-type passenger door for use in other motor vehicles, with each door module illustrating the operative association between the closure latch assembly and the cinch assembly.

For purpose of clarity in describing its functional association with motor vehicle 10, the closure panel illustrated in this non-limiting embodiment is hereinafter referred to as door 16. FIG. 2A generally indicates a swing-type door 16 for motor vehicle 10 being equipped with a cinch assembly 30 that is operatively connected to a latch cinch mechanism 50 associated with closure latch assembly 18 via a cable assembly 32 to provide a remote mounting arrangement therebetween. FIG. 2B is provided to illustrate a similar arrangement between closure latch assembly 18 and cinch assembly 30 in a sliding-type door 16' that is adapted for use in other vehicles, such as mini-vans.

Figure 3:
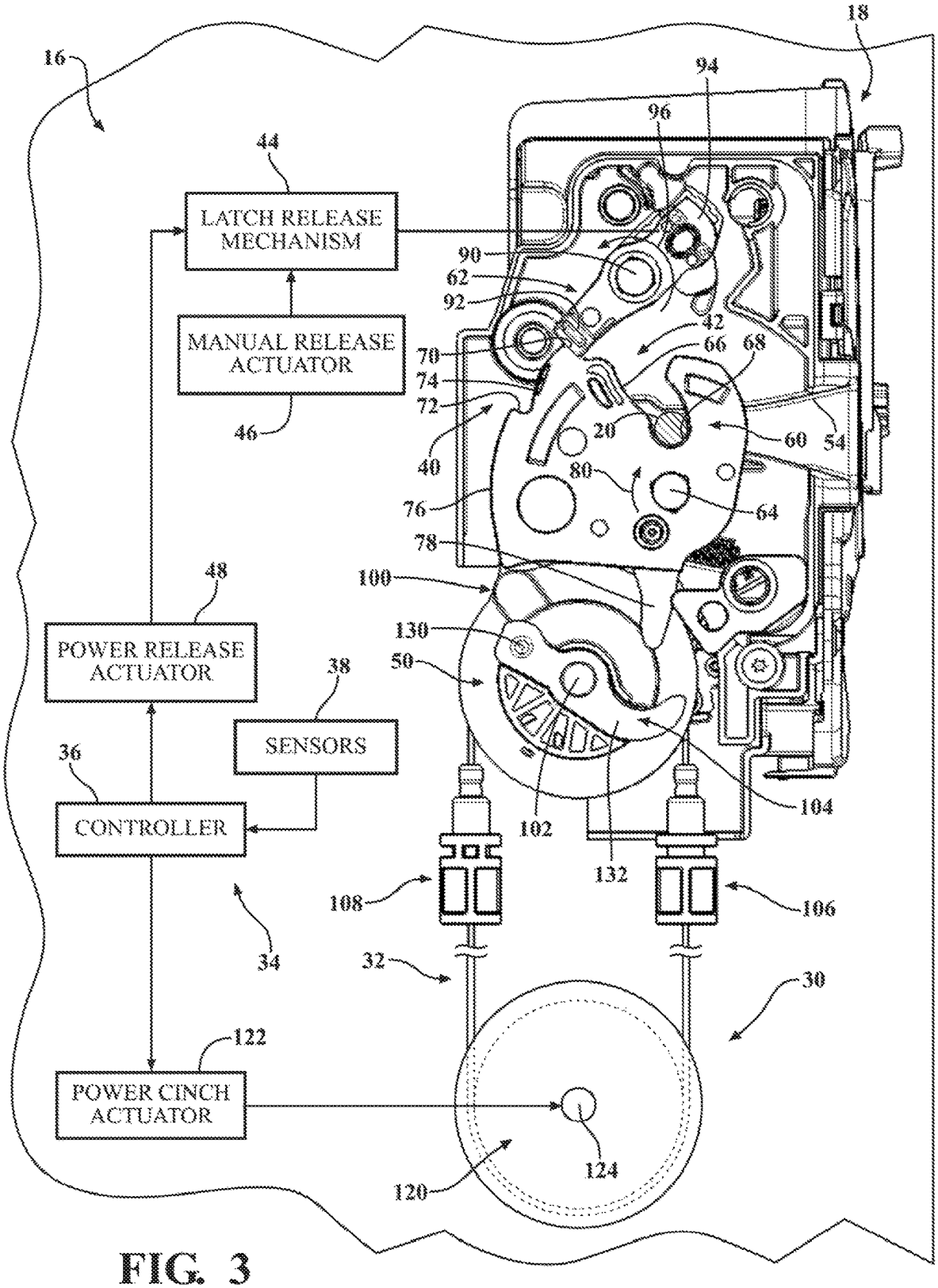
FIG. 3 is an elevational view of the closure latch assembly constructed in accordance with the present disclosure and which is configured to generally include a latch mechanism, a power latch release mechanism, a manual latch release mechanism, a power latch cinch mechanism operably driven by the cinch assembly, and a latch control system.

Referring initially to FIG. 3, various components of closure latch assembly 18 and their interaction with cinch assembly 30 are shown associated with a latch control system 34 schematically shown to generally include a latch controller or latch ECU 36 and a group of latch sensors 38. Latch controller 36 may be provided for example internally in the latch housing as an integral unit. In this non-limiting embodiment, closure latch assembly 18 is generally shown to include a latch plate 40, a latch mechanism 42, a latch release mechanism 44, a manual latch release actuator 46, a power latch release actuator 48, and the latch cinch mechanism 50 which is operatively connected via cable assembly 32 to cinch assembly 30.

Figure 4:
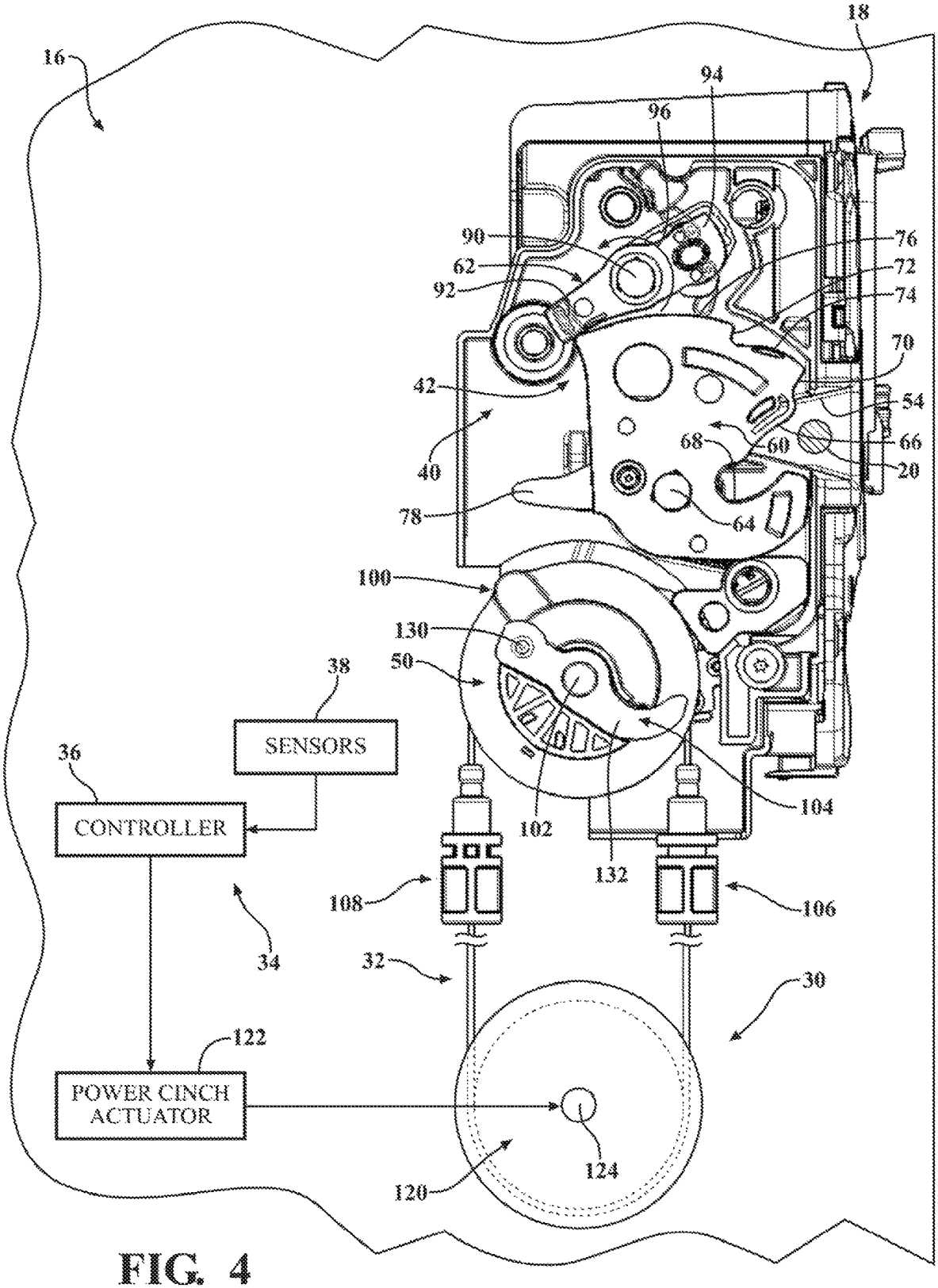
FIG. 4 is an elevational view, generally similar to FIG. 3, showing the closure latch assembly operating in an Unlatched-Released (i.e. latch open) mode when the passenger door is located in an open position and illustrating the latch mechanism in a released state, the latch release mechanism in a pawl released state, and the latch cinch mechanism in a non-actuated state.
Figure 5:
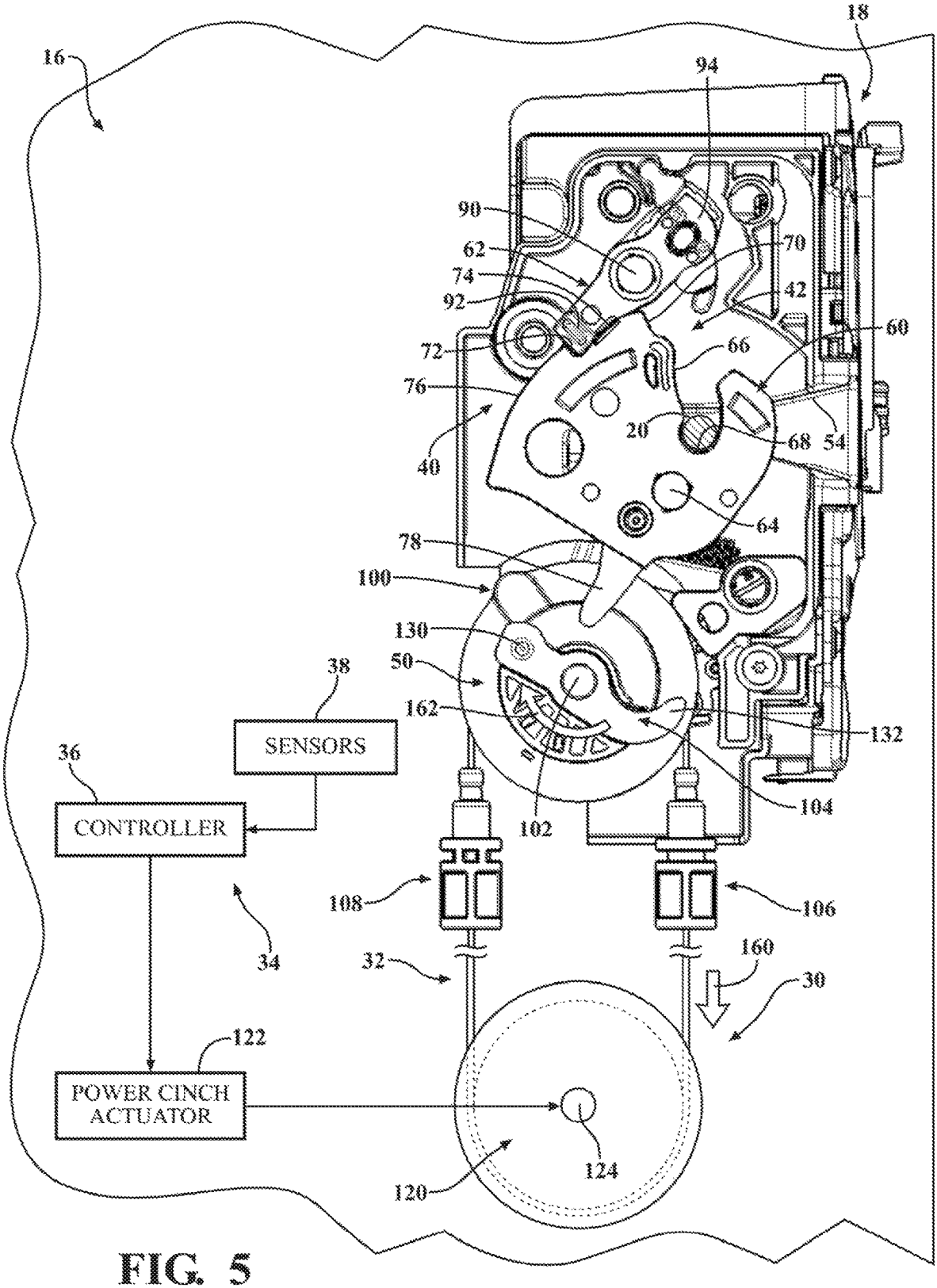
FIG. 5 is another similar elevational view now showing the closure latch assembly operating in a Latched-Uncinched (i.e. secondary latched) mode when the passenger door is moved into a partially-closed position and illustrating the latch mechanism in a soft latched state, the latch release mechanism in a pawl engaged state, and the latch cinch mechanism being shifting from its non-actuated state into a cinch-actuated state in response to actuation of the cinch assembly in a first direction for initiating a power release operation.

To better illustrate operation of closure latch assembly 18 and cinch assembly 30, FIGS. 4 through 9 are a series of sequential views illustrating a power cinching function. More particularly, these drawings illustrate shifting of closure latch assembly 18 from an Unlatched-Released or "latch open" mode when door 16 is open (FIG. 4) into a Latch-Uncinched or "secondary latched" mode when door 16 is moved into a partially-closed (i.e. "soft close") position (FIG. 5). The power cinching function is operable to shift closure latch assembly 18 from its secondary latched mode into a Latched-Cinched or "primary latched" mode for moving door 16 from its partially-closed position into its fully-closed or (i.e. "hard close") position, shown in FIGS. 7-9. Movement of door 16 from its partially-closed position to its fully-closed position can be accomplished manually based on the closure force exerted by the vehicle operator thereon or, in the alternative, can be accomplished via the power cinching operation as a result of cinch assembly 30 actuating latch cinch mechanism 50 in a first or "cinching" direction (clockwise as shown in FIGS. 4-9).

Additionally, FIGS. 10-14 are another series of sequential views illustrating a power opening or "ice breaking" function, where the cinch assembly 30 may be driven in an opposite rotation direction to assist the closure latch assembly 18 in opening, and for example to assist with the movement, such as the rotation, of the ratchet 60 towards the striker release position from at least one of the secondary striker capture position, and to the primary striker capture position and also to assist with moving the striker 20 and the door 16. Specifically, these drawings illustrate closure latch assembly 18 being shifted from its primary latched mode (FIGS. 9-10) into its latch open mode (FIG. 14) in response to detection by latch sensors 38 that latch mechanism 42 is frozen (i.e. door 16 is frozen in its fully-closed position) via cinch assembly 30 actuating latch cinch mechanism 50 in a second or "ice breaking" direction (counter-clockwise in FIGS. 10-14). For example, actuation of a power cinch actuator 122 in a second direction functions to open the latch mechanism 42, that is actuation of the power cinch actuator 122 in a second direction functions to impart movement, such as the rotation, of the ratchet 60 when the pawl 62 is in the striker release position before actuation of the power cinch actuator 122 or for example, actuation of the power cinch actuator 122 in a second direction functions to impart movement, such as the rotation, of the ratchet 60 when the pawl 62 is nearly in the striker release position before actuation of the power cinch actuator 122 such that actuation of the power cinch actuator 122 in a second direction functions to impart movement, such as the rotation, of the ratchet 60 which may assist the pawl 62 to move to the striker release position. Further details of both the power cinching function and the power ice breaking function will be provided as each of the views shown in FIGS. 4-14 is described in more detail hereinafter.

Figure 7:
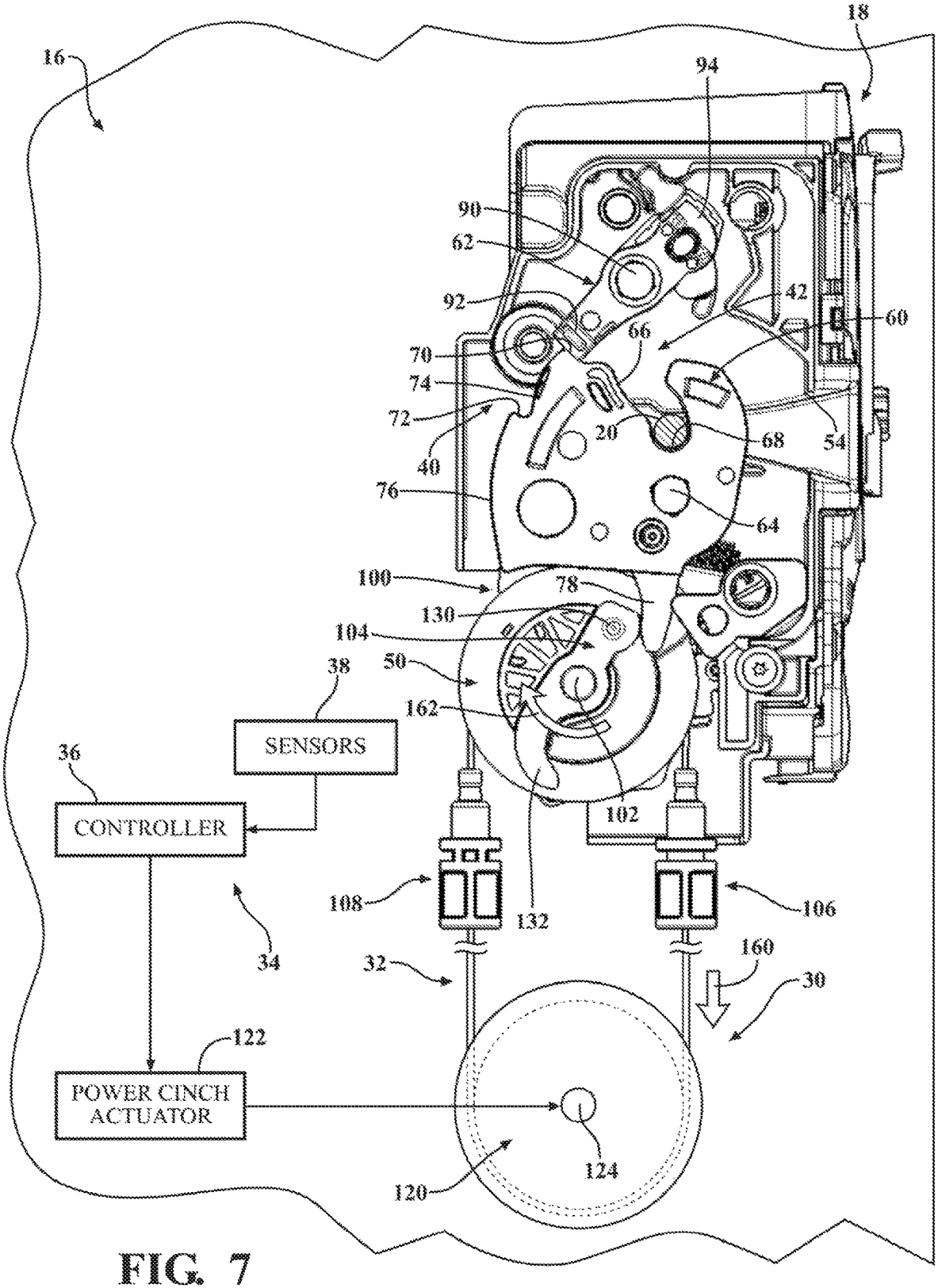
Figure 8:
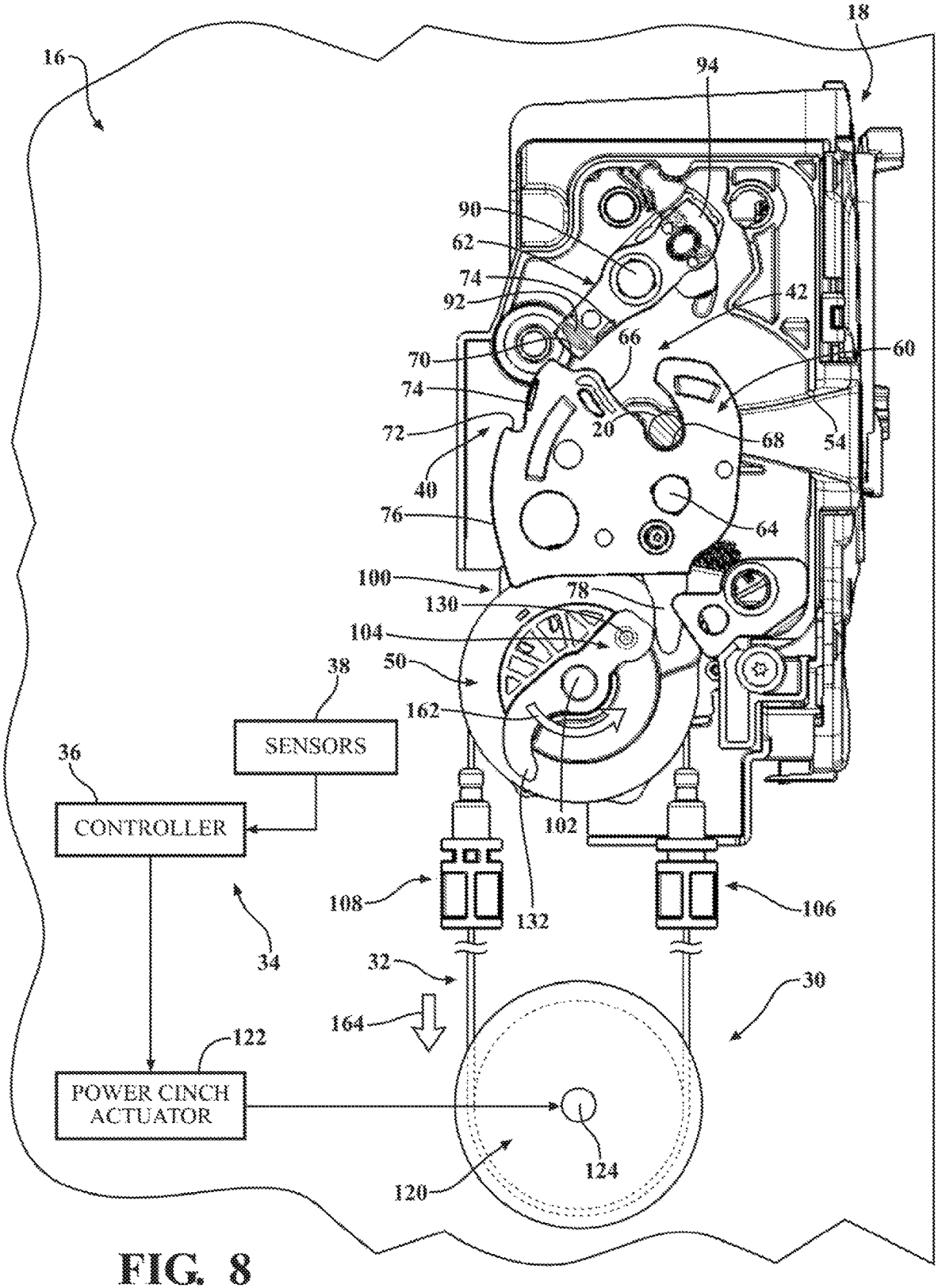

With reference at least to FIG. 4, latch plate 40 is part of a latch housing and is adapted to be fixedly secured to edge portion 16A of door 16 (FIG. 1). Latch plate 40 defines an entry aperture 54 through which striker 20 (FIG. 1) travels upon movement of door 16 relative to vehicle body 12. Latch mechanism 42 is shown, in this non-limiting embodiment, as a single pawl/ratchet configuration including a ratchet 60 and a pawl 62. Ratchet 60 is mounted for pivotal movement on latch plate 40 via a ratchet pivot 64. Ratchet 60 is configured to include a contoured guide channel 66 (along which the striker 20 may slide during opening and closing of the door 16), which terminates in a striker capture pocket 68, a primary latch notch 70 (against which the pawl 62 may rest), a secondary latch notch 72 (against which the pawl 62 may rest), a first cam surface 74 (against which the pawl 62 may slide), a second cam surface 76 (against which the pawl 62 may slide), and a ratchet actuation lug 78 (for engaging with the cinch mechanism 50). Latch mechanism 42 also includes a ratchet biasing member, schematically shown by arrow 80, which is configured to normally bias ratchet 60 in a first or "releasing" direction (i.e. clockwise in FIG. 3). Accordingly, the latch mechanism 42, and the ratchet 60, is biased to be open to allow the striker 20 be released from the latch mechanism 42. Ratchet 60 is rotatable through a range of bi-directional rotary motion between a striker release position (FIG. 4), a secondary striker capture position (FIG. 5), a primary striker capture position (FIG. 7), and an overslam striker capture position (FIG. 8). Thus, ratchet biasing member 80 normally biases ratchet 60 towards its striker release position. A ratchet sensor, associated with latch sensors 38, is operable for providing latch controller 36 with a ratchet position signal. Latch mechanism 42 defines a released state when ratchet 60 is located in its striker release position (FIG. 4), a soft latched state when ratchet 60 is located and held in its secondary striker capture position (FIG. 5), and a hard latched state when ratchet 60 is located and held in its primary striker capture position (FIG. 7). As is well understood, ratchet 60 functions to retain striker 20 within entry channel 54 of latch plate 40 and within striker capture pocket 68 when ratchet 60 is held in one of its secondary and primary striker capture positions to respectively hold door 16 in the corresponding one of its partially-closed and fully-closed positions.

Pawl 62 is supported for pivotal movement on latch plate 40 via a pawl pivot 90. Pawl 62 is configured to include a pawl latch lug segment 92 and a pawl actuation lug segment 94. Pawl 62 is moveable between a ratchet releasing position (FIG. 4) and a ratchet holding position (FIGS. 5 and 7) and is normally biased in a latching direction (i.e. counterclockwise) toward its ratchet holding position via a pawl biasing member, shown schematically by arrow 96. When door 16 is located in its open position, pawl latch lug segment 92 rests on ratchet 60 for mechanically holding pawl 62 in its ratchet releasing position (as shown in FIG. 4). When door 16 is located into its partially-closed position, pawl latch lug segment 92 of pawl 62 is biased by pawl biasing member 96 and rides along second cam surface 76 on ratchet and then into engagement with secondary latch notch 72 on ratchet 60 such that pawl 62 is located in its ratchet holding position for mechanically holding ratchet 60 in its secondary striker capture position (shown in FIG. 5). Upon movement of door 16 from its partially-closed position into its fully-closed position, pawl actuation lug segment 92 initially rides along first cam surface 74 until it moves into engagement with primary latch notch 70 on ratchet 60 such that pawl 62 is again located in its ratchet holding position for mechanically holding ratchet 60 in its primary striker capture position (shown in FIGS. 6-7). A pawl sensor, associated with latch sensors 38, is operable to provide latch controller 36 with a pawl position signal, which can therefore indicate the state of the ratchet 60.

Latch release mechanism 44, while only shown schematically in FIG. 3, is understood to be operatively coupled (directly or indirectly) to pawl actuation lug segment 94 of pawl 62 for selectively moving pawl 62 from its ratchet holding position to its ratchet releasing position, in opposition to the biasing of pawl biasing member 96, when it is desired to shift latch mechanism 42 from either of its soft latched and hard latched states into its released state. Latch release mechanism 44 is operable in a pawl released state for moving pawl 62 from its ratchet holding position to its ratchet releasing position and is further operable in a pawl engaged state to maintain pawl 62 in its ratchet holding position. Those skilled in the art will understand that latch release mechanism 44 can be configured to include any number of mechanical components (i.e. release levers, release links, etc.) operable to control movement of pawl 62 between its ratchet holding and ratchet releasing positions. Manual release actuator 46 is schematically illustrated to identify components (i.e. linkages, cables, etc.) used to interconnect at least one of outside handle 22 and inside handle 24 to latch release mechanism 44 so as to permit release of latch mechanism 42 via manual actuation of latch release mechanism 44. Likewise, a power release actuator 48 is schematically illustrated to identify components used to control powered actuation of latch release mechanism 44 so as to permit power release of latch mechanism 42. Power release actuator 48 can include, for example, an electric motor and gear-driven cam arrangement that are operable to shift latch release mechanism 44 from its pawl engaged state into its pawl released state in response to a latch release signal being supplied to latch controller 36 from a passive keyless entry transmitter (i.e. by fob) or from a handle-mounted release switch.

With reference to FIG. 3, latch cinch mechanism 50 is generally shown, in this non-limiting embodiment, to include a driven pulley 100 rotatably mounted to latch plate 40 for rotation about a driven pulley pivot 102, and a ratchet lever 104 fixedly secured to driven pulley 100 for common rotation about driven pivot 102. A first end of cable assembly 32, referred to as cinch cable 106, is secured to a first part of driven pulley 100 while a second end of cable assembly 32, referred to as open cable 108, is secured to a second part of driven pulley 100. Cable assembly 32 is also spooled or looped around a drive pulley 120 associated with cinch assembly 30. The power cinch actuator 122 is also associated with cinch assembly 30 and is operable to cause rotation of drive pulley 120 about a drive pulley pivot 124 which, in turn, causes concomitant rotation of driven pulley 100 about driven pulley pivot 102. Power cinch actuator 122 is configured, for example, as an electric motor and geartrain that is operable to rotate drive pulley 120 in response to electrical latch control signals from latch controller 36.

Ratchet lever 104 is configured to include a cinch cam 130 and an ice breaker cam 132, each of which are selectively engageable with ratchet actuation lug 78 based on the direction of rotation of driven pulley 100. More particularly, when drive pulley 100 is rotated to locate ratchet lever 104 in a rest position (FIGS. 4 and 5), a non-actuated state is established for latch cinch mechanism 50. In contrast, rotation of driven pulley 100 in the first or "cinching" (i.e. clockwise) direction causes ratchet lever 104 to rotate from its rest position toward a ratchet cinched position (FIG. 7) for shifting latch cinch mechanism 50 from its non-actuated state into a cinch-actuated state and providing the power cinching function to fully close the door 16. In addition, rotation of driven pulley 100 in the second or "ice breaking" (i.e. counterclockwise) direction causes ratchet lever 104 to rotate from its rest position toward a ratchet opened position (FIG. 13) for shifting latch cinch mechanism 50 from its non-actuated state into an ice breaker-actuated state for providing the power ice-breaking function to open the door 16. A driven pulley sensor associated with latch sensors 38, provides latch controller 36 with a driven pulley position signal indicative of the position of ratchet lever 104. Cinch cam 130 on ratchet lever 104 is configured to engage ratchet actuation lug 78 to forcibly drive ratchet 60 from its secondary striker capture position to its primary striker capture position as part of the power cinching operation. In contrast, ice breaker cam 132 on ratchet lever 104 is configured to engage ratchet actuation lug 78 and forcibly drive ratchet 60 from its primary striker capture position to its striker release position as part of the ice-breaking function.

Referring initially to FIG. 4, door 16 is located in its open position such that closure latch assembly 18 is operating in its latch open mode. Accordingly, the striker 20 may be received into the ratchet 60 as the ratchet 60 is broke toward the striker 20 in a door closing operation. As seen, latch mechanism 42 is in its released state with ratchet 60 located in its striker release position and pawl 62 located in its ratchet releasing position. As such, pawl latch lug segment 92 on pawl 62 rests on second cam surface 76 of ratchet 60. In addition, latch cinch mechanism 50 is in its non-actuated state with ratchet lever 104 located in its rest position.

FIG. 5 illustrates rotation of ratchet 60 from its striker release position (FIG. 4) into its secondary striker capture position caused by striker 20 engaging ratchet guide channel 66 in response to door 16 being moved from its open position to its partially-closed position. As the striker 20 impacts the ratchet 60, the ratchet 60 is caused to rotate counter-clockwise, and the pawl 62 will slide along the second cam surface 76 during rotation of the ratchet 60 and into engagement with the secondary latch notch 72. As such, closure latch assembly 18 is now operating in its secondary latched mode with latch mechanism 42 in its soft latched state. As shown, with latch mechanism 42 in its soft latched state, ratchet 60 is held in its secondary striker capture position by pawl 62 being located in its ratchet holding position due to retention of pawl latch lug segment 92 against secondary latch notch 72. Latch sensors 38 associated with pawl 62 and ratchet 60 provide indicative position signals to latch controller 36 which then initiates the power cinching function. Specifically, in response to receiving indicative position signals from the latch sensors 38, power cinch actuator 122 is actuated to rotate drive pulley 120 in the cinching direction for pulling on cinch cable 106, as indicated by arrow 160, and which, in turn, rotates driven pulley 100 via cable assembly 32 in the cinching direction, as indicated by arrow 162. As such, ratchet lever 104 begins rotating from its rest position toward its ratchet cinched position. Thus, latch cinch mechanism 50 is transitioned from its non-actuated state into its cinch-actuated state due to rotation of ratchet lever 104 in the cinching direction.

Figure 6:
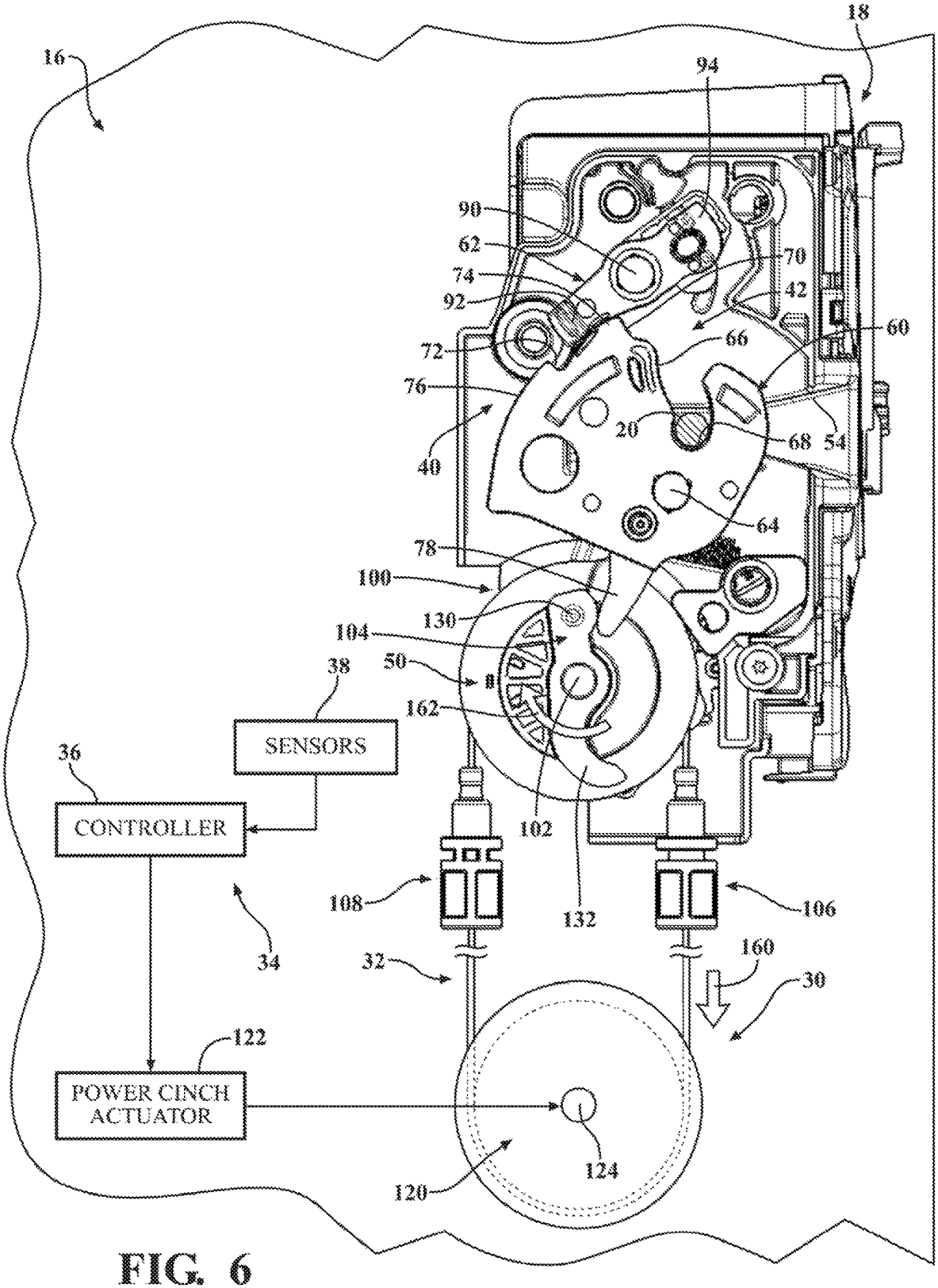
FIGS. 6 through 8 are sequential elevational views, generally similar to FIG. 5, but which illustrate the closure latch assembly shifting from its secondary latched mode into a Latched-Cinched (i.e. primary latched) mode upon continuation of the power cinching operation with the latch mechanism transitioning from its soft latched state to a hard latched state in response to continued operation of the latch cinch mechanism in its cinch-actuated state due to continued actuation of the cinch assembly in the first direction.

FIG. 6 illustrates that continued rotation of driven pulley 120 in the cinching direction (arrow 160) and also continues to cause common rotation of drive pulley 100 (arrow 162) such that cinch cam 130 on ratchet lever 104 engages ratchet actuation lug 78 and causes ratchet 60 to rotate from its secondary striker capture position towards its primary striker capture position. Pawl 62 will slide along cam surface 76 of the ratchet 60 as the ratchet 60 rotates after disengaging from the secondary latch notch 72.

FIG. 7 illustrates that continued engagement of cinch cam 130 with ratchet actuation lug 78 in response to continued rotation of driven pulley 100 in the cinching direction functions to eventually locate ratchet 60 in its primary striker capture position with pawl latch lug segment 92 retained against primary latch notch 70. Note that ratchet lever 104 is shown in its ratchet cinched position. The positioning of the pawl 62 in the primary latch notch 70 will prevent the ratchet 60 from rotating clockwise and releasing the striker 20. In this state, the latch mechanism 42 is in the hard latched state, the ratchet 60 is in the primary striker capture position, and the pawl 62 is in its ratchet holding position. The cinch mechanism 50 is in its cinch activated state.

Figure 9:
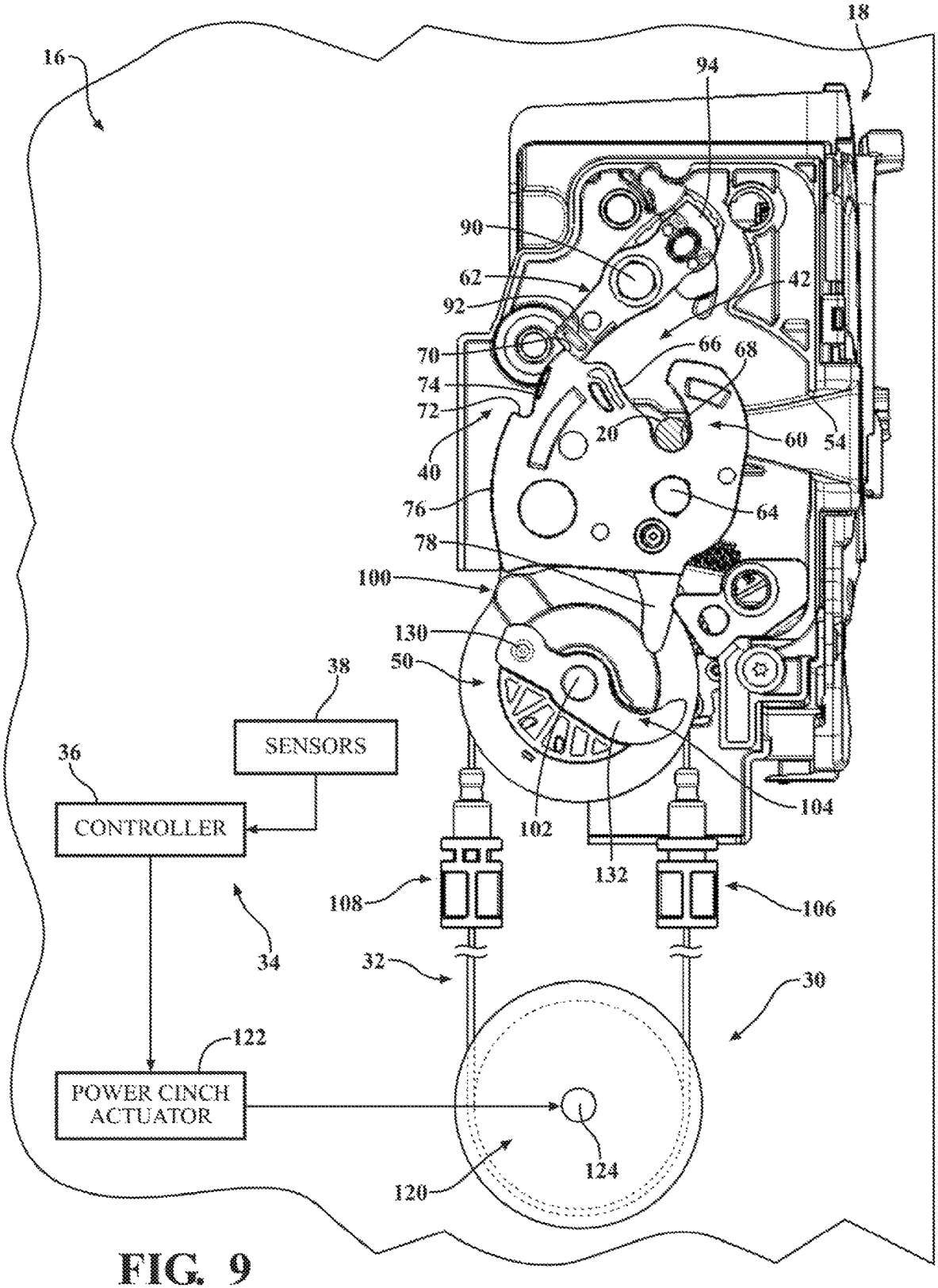
FIG. 9 is yet another elevational view now showing the closure latch assembly operating in its primary latched mode when the passenger door is located in its fully-closed position upon completion of the power cinching operation, with the cinch assembly actuated in a second direction to reset the latch cinch mechanism into its non-actuated state.

FIG. 8 illustrates ratchet lever 104 further rotated to an overslam position for locating ratchet 60 in its overslam striker capture position. Pawl 62 remains in its ratchet holding position but its pawl latch lug segment 92 momentarily disengages primary latch notch 70. At this point, latch controller 36 reverses the direction of power cinch actuator 122 for causing drive pulley 120 to rotate in the second or "ice breaking" direction for pulling on open cable 108 (arrow 164) which, in turn, causes similar rotation of driven pulley 100 (arrow 166). This function is intended to rotate ratchet lever 104 back to its rest position, thereby resetting latch cinch mechanism 50 in its non-actuated state, as shown in FIG. 9. This action of reversing the drive direction of power cinch actuator 122 is predicated on positions signals from latch sensors 38 and/or other operational characteristics such as, for example, expiration of a predefined cinch time or driven pulley 100 engaging a hard stop portion of latch plate 40. Accordingly, the sequence of drawings shown in FIGS. 4-9 illustrate the power cinching function provided by driving ratchet lever 104 of latch cinch mechanism 50 in the first direction. The reversal of direction of the power cinch actuator 122 and the driven pulley 100 may be in response to latch controller 36 receiving a pulley sensor signal. FIG. 8 illustrates the components at a moment where the overslam position is reached, and also at the time that the pulley 100 stops rotating in the clockwise direction and starts rotating in the counter-clockwise direction. FIG. 9 illustrates the pulley 100 having been rotating back to the non-actuated or rest position, and the ratchet 60 and pawl 62 are in the same position and state illustrated in FIG. 7.

Referring now to FIGS. 10-14, the power ice-breaking function provided by the interaction of latch cinch mechanism 50 of closure latch assembly 18 and cinch assembly 30 is described and results due to rotation of drive pulley 120 in the second (i.e. ice-breaking) direction for shifting latch cinch mechanism 50 from its non-actuated state into its ice breaker-actuated state. Generally speaking, the power ice breaking function is required when latch mechanism 42 is "frozen" in its primary latched state after latch release mechanism 44 has been shifted from its pawl engaged state into its pawl released state. Put another way, the ratchet 60 may be allowed to rotate to an open position due to its rotational bias and the pawl 62 having moved, but the ratchet 60 has not moved because the door 16 has not shifted to open. This situation may occur, for example, when door 16 is frozen to vehicle body 12 in its fully-closed position. As such, the power ice breaking function is configured to mechanically move ratchet 60 from its primary striker capture position to its striker release position for driving striker 20 out of guide channel 66 while pawl 62 is held in its ratchet releasing position. This power ice breaking function can also be referred to as a power "opening" function since it may be configured to move door 16 (via the interaction between striker 20 and ratchet 60) to a partially-open (i.e. "presentment") position.

Figure 10:
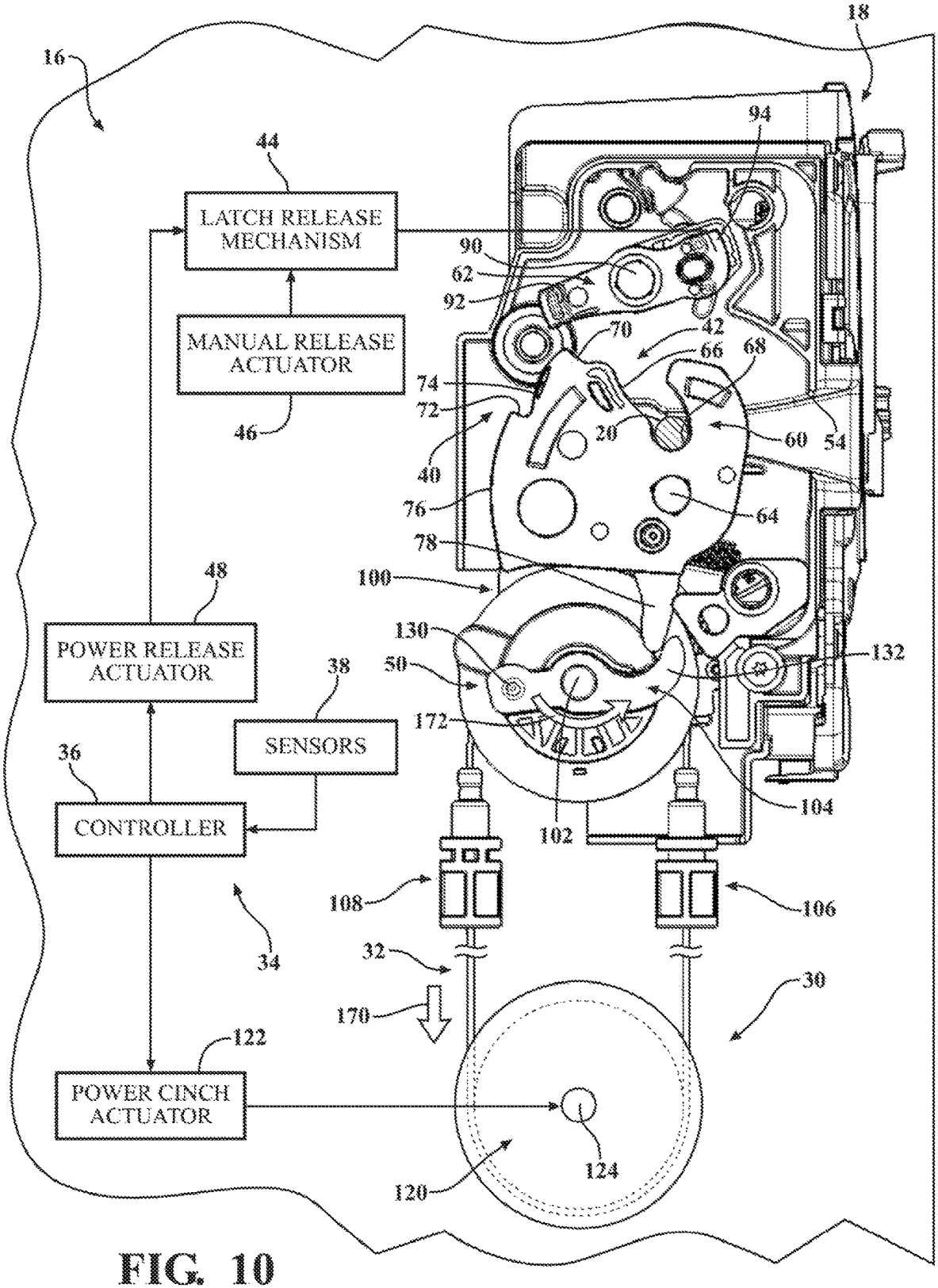
FIG. 10 illustrates the closure latch assembly following actuation of the latch release mechanism into its pawl released state when the passenger door is frozen such that the latch mechanism is held in its hard latched state, thereby causing initiation of a power opening or ice-breaking operation by shifting the latch cinch mechanism from its non-actuated state into an ice break-actuated state in response to actuation of the cinch assembly in the second direction.

Referring initially to FIG. 10, door 16 is located in its fully-closed position such that closure latch assembly 18 is operating in its primary latched mode. FIG. 10 illustrates the situation when pawl 62 has been moved by latch release mechanism 44 to its ratchet releasing position, but ratchet 60 remains "frozen" in its primary striker capture position. In typical non-frozen conditions, upon release of pawl 62, ratchet biasing member 96 and the release of the compressive seal loads applied by weatherseal 28 on striker 20 would cause ratchet 60 to rotate in the releasing direction to its striker release position. Once latch sensors 38 detect that ratchet 60 is being held in its primary striker capture position following movement of pawl 62 to its ratchet releasing position, latch controller 36 will initiate the ice breaking function. Specifically, in response to receiving a signal from sensors 38, the power cinch actuator 122 will be actuated to rotate drive pulley 120 in the ice breaking (i.e. counterclockwise) direction (arrow 170) which, in turn, rotates driven pulley 100 and ratchet lever 104 in the same direction (arrow 172). This action causes ratchet lever 104 to move from its rest position toward its ratchet opened position which, in turn, causes ice breaker cam 132 on ratchet lever 104 to engage ratchet actuation lug 78 on ratchet 60. As shown in FIG. 10, ice breaker cam is in contact with lug 78, having been rotated relative to FIG. 9.

Figure 11:
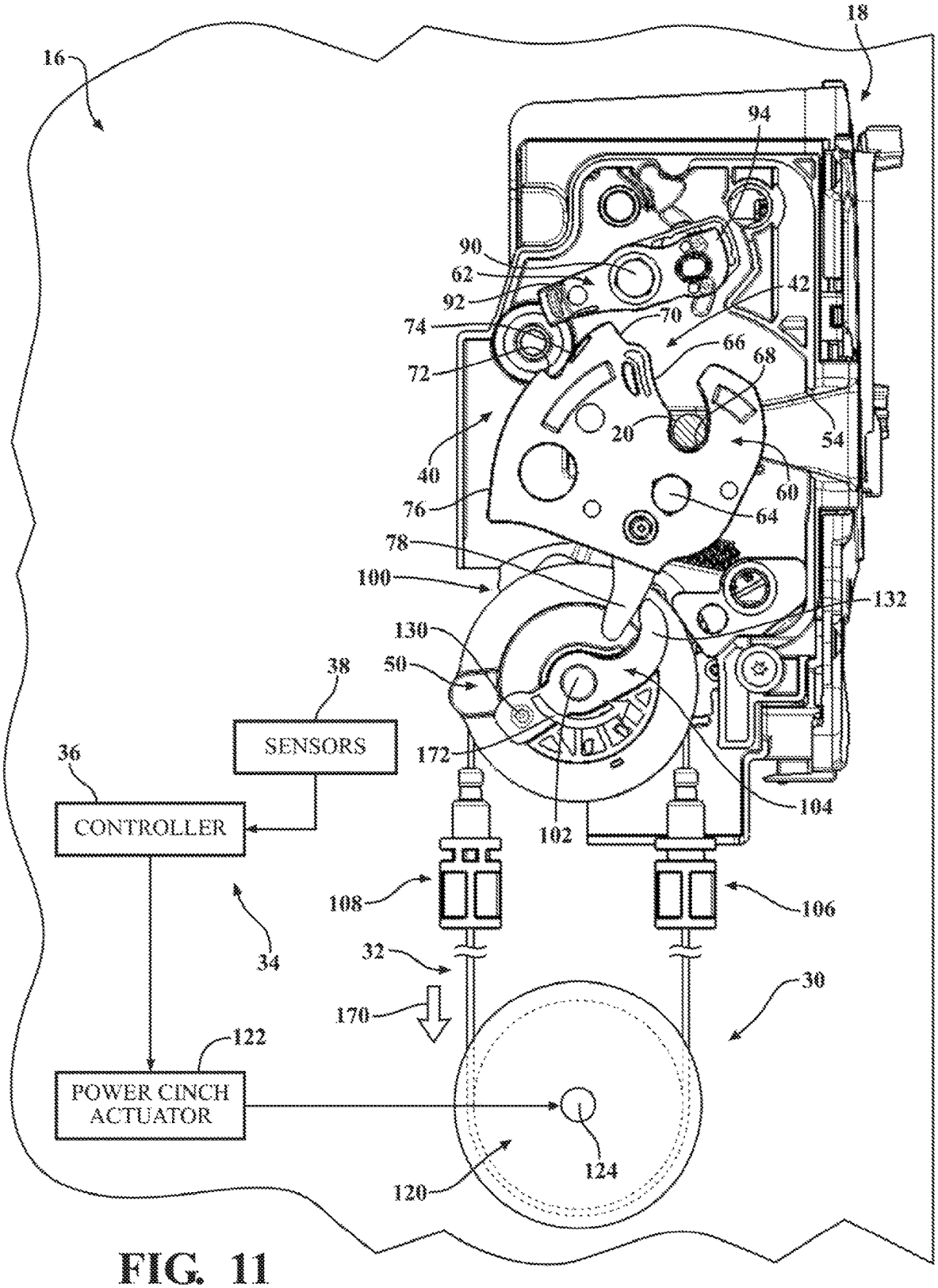
FIGS. 11 through 14 are a series of sequential elevational views of the closure latch assembly which illustrate completion of the power ice breaking operation for forcibly shifting the latch mechanism back to its released state and the subsequent resetting of the latch cinch mechanism into its non-actuated state.
Figure 12:
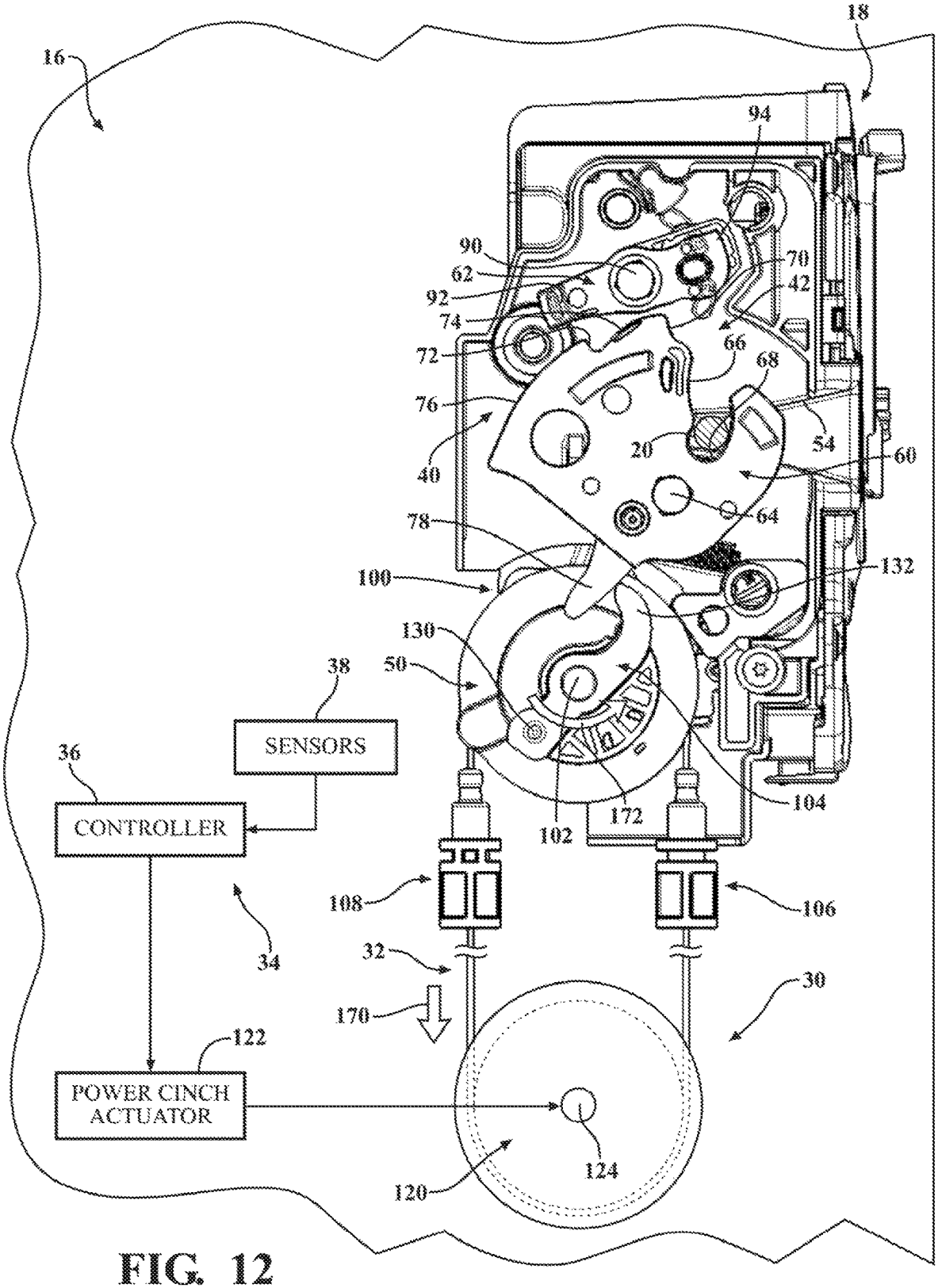
Figure 13:
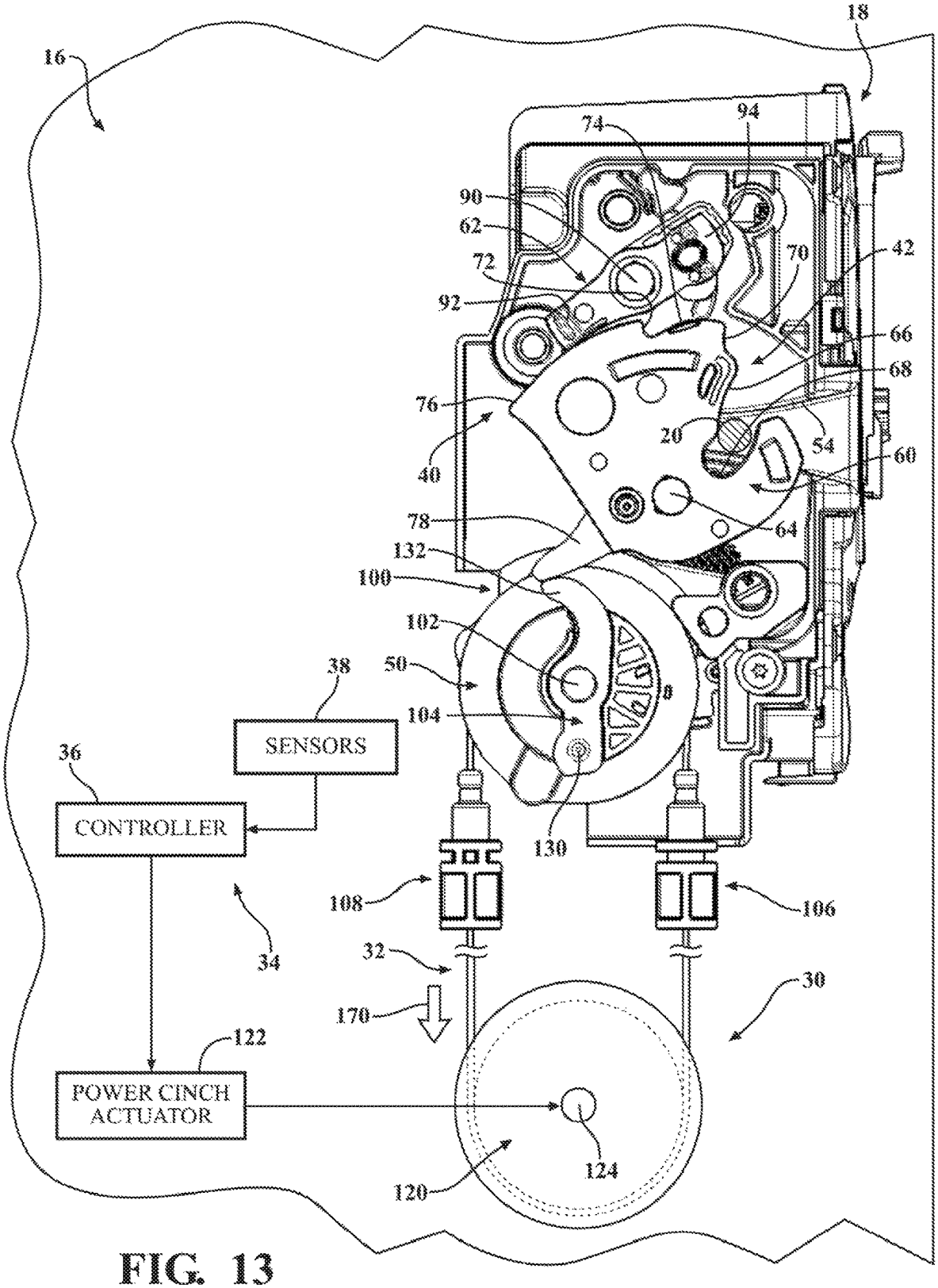
Figure 14:
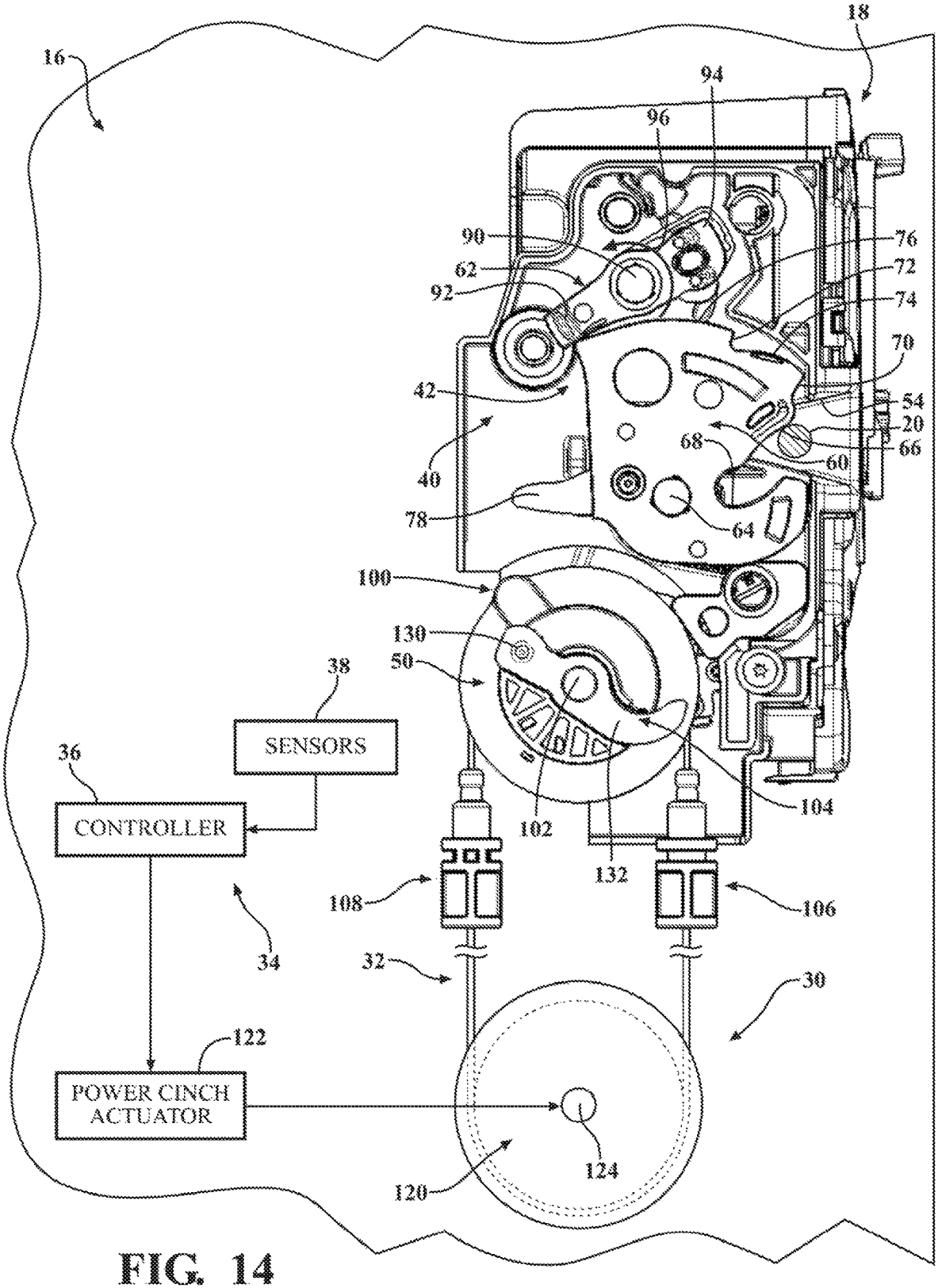

FIGS. 11-13 illustrate that continued rotation of driven pulley 100 in the second direction causes ratchet lever 104 to forcibly rotate ratchet 60 in its releasing direction toward its striker release position due to continued engagement of ice breaker cam 132 with ratchet actuation lug 78. Latch controller 36 will continue to energize power cinch actuator 122 for such rotation of driven pulley 100 until the ratchet sensor associated with latch sensors 38 indicates that ratchet 60 is located in its striker release position (FIG. 14). Thereafter, power cinch actuator 122 is reversed for rotation of driven pulley 100 in the first direction for returning ratchet lever 104 from its ratchet opened position to its rest position, thereby resetting latch cinch mechanism 50 in its non-actuated state, shown in FIG. 14. Note, FIG. 14 is similar to FIG. 4, in that the ratchet 60 is open and free to receive the striker 20 when the door closes.

FIG. 11 illustrates the ratchet lever 104 rotated counterclockwise relative to FIG. 10, and the ratchet 60 rotated clockwise relative to FIG. 10. The pawl 62 remains disengaged from the ratchet 60, allowing the ratchet 60 to rotate. The bias on the ratchet 60 also operates to rotate the ratchet 60 toward the open position. The rotation of the ratchet 60 will mechanically move the striker 20 retained by the ratchet 60, thereby helping force the door 16 open to overcome the condition that resulted in the door 16 being stuck, such as ice.

FIG. 12 similarly illustrates further rotation of the ratchet lever 104 and the ratchet 60 while the pawl 62 remains energized in its ratchet release state to allow the ratchet 60 to rotate toward the open position.

FIG. 13 illustrates further rotation of the ratchet lever 104 and the ratchet 60 while the pawl 62 remains energized in its ratchet release state to allow the ratchet 60 to rotate toward the open position. In FIG. 13, the ratchet 60 has rotated enough such that the pawl 62 may be de-energized such that the bias on the pawl 62 allows the pawl to re-engage the ratchet 60, but at a point on the ratchet 60 such that the ratchet 60 may continue to rotate toward the open position. The ratchet lever 104 has traveled approximately to the end of its engagement with the lug 78. The sensors 38 may detect the position of the ratchet lever 104, and send a signal that causes the controller 36 to rotate the pulley 100 back toward its rest position. The reversal of the rotation of the pulley 100 may also occur when the pulley 100 reaches a hard stop point. In FIG. 13, the door 16 is not yet in a fully open position, but the ratchet 60 has rotated to open the door 16 slightly to break the ice. The ratchet 60 is still biased toward the open position and not blocked by the pawl 62 at this point, such that the bias on the ratchet 60 may operate to complete the door opening operation such that the striker 20 is free, or a manual load exerted by a vehicle occupant may be applied with minimal effort due to the frozen or stuck condition of the door 16 being overcome.

Figure 15:
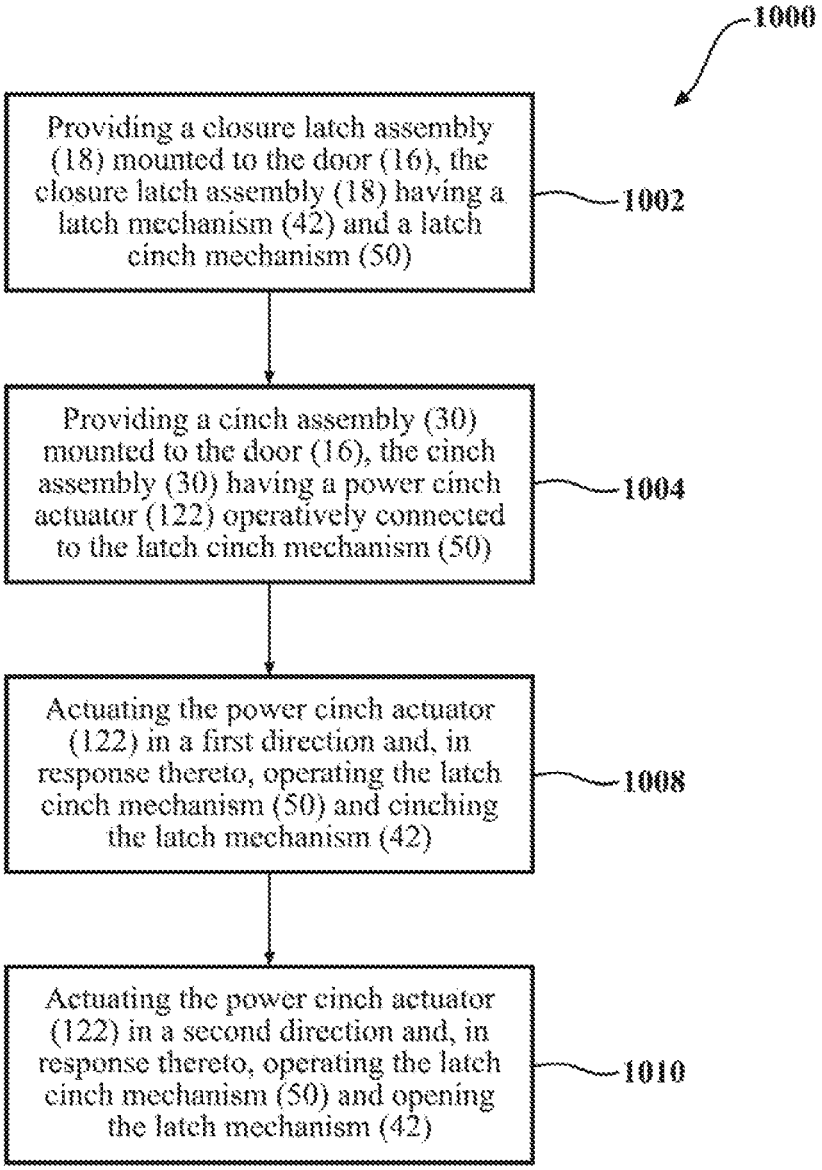
FIG. 15 is a flow chart diagram of one aspect of a method of operating the closure latch assembly and cinch assembly.

FIG. 15 illustrates one aspect of a method 1000 of operating the system. At step 1002, the method includes providing the closure latch assembly 18 mounted to the door 16, the closure latch assembly 18 having the latch mechanism 42 and the latch cinch mechanism 50. At step 1004, the method includes providing the cinch assembly 30 mounted to the door 16, the cinch assembly 30 having the power cinch actuator 122 operatively connected to the latch cinch mechanism 50. At step 1006, the method includes actuating the power cinch actuator 122 in a first direction and, in response thereto, operating the latch cinch mechanism 50 and cinching the latch mechanism 42. At step 1008, the method includes actuating the power cinch actuator 122 in a second direction and, in response thereto, operating the latch cinch mechanism 50 and opening the latch mechanism 42.

The method 1000 may also include receiving the striker 20 in the latch mechanism 42 of the closure latch assembly 18 wherein the latch mechanism 42 includes the ratchet 60 rotatable between a striker release position, a secondary striker capture position, and a primary striker capture position; rotating the ratchet 60 from the striker release position to the secondary striker capture position; rotating the latch cinch mechanism 50 in the first direction and, in response thereto, rotating the ratchet 60 from the secondary striker capture position to the primary striker capture position; rotating the latch cinch mechanism 50 in the second direction and, in response thereto, rotating the ratchet 60 from the primary striker capture position toward the striker release position; and rotating the ratchet 60 to the striker release position.

The method 1000 may also include, in response to rotating the ratchet 60 from the striker release position to the secondary striker capture position, positioning the pawl 62 of the latch mechanism 42 to a first ratchet holding position against the ratchet 60 to block rotation of the ratchet 60 toward the striker release position; in response to rotating the ratchet 60 from the secondary striker capture position to the primary striker capture position, positioning the pawl 62 in a second ratchet position to block rotation of the ratchet 60 toward the striker release position; prior to rotating latch cinch mechanism 50 in the second direction, positioning the pawl 62 in a ratchet releasing position to allow the ratchet 60 to rotate toward the striker release position.

In another aspect, the method 1000 may include, at the latch controller 36, receiving a first signal from one or more sensors 38 indicating a door closing condition of the latch mechanism 42; in response thereto, sending a first command from the latch controller 36 to the power cinch actuator 122 to actuate the power cinch actuator 122 in the first direction; and at the latch controller 36, receiving a second signal from the one or more sensors 38 indicating a door opening condition of the latch mechanism 42; in response thereto, sending a second command from the latch controller 36 to the power cinch actuator 122 to actuate the power cinch actuator 122 in the second direction.

The method 1000 may also include prior to receiving the first signal, rotating the ratchet 60 of the latch mechanism 42 from a striker release position to a secondary striker capture position and, in response thereto, positioning the pawl 62 of the latch mechanism 42 in a first ratchet holding position; in response to actuating the power cinch actuator 122 in the first direction, rotating the ratchet 60 of the latch mechanism 42 from the secondary striker capture position to a primary striker capture position; and, prior to receiving the second signal, rotating the pawl 62 to a ratchet releasing position; and in response to actuating the power cinch actuator 122 in the second direction, rotating the ratchet 60 from the primary striker capture position toward the striker release position.

In one aspect of the method 1000, the first signal includes a first pawl position signal and a first ratchet position signal indicating that the pawl 62 is in the first ratchet holding position and indicating that the ratchet 60) is in the secondary striker capture position, and wherein the second signal includes a second pawl position signal and a second ratchet position indicating the pawl is in the ratchet releasing position and that the ratchet 60 is in the primary striker capture position.

In one aspect of the method 1000, in response to operating the latch cinch mechanism 50 and cinching the latch mechanism 42, the method 1000 includes actuating the power cinch actuator 122 in second direction and positioning the latch cinch mechanism in a rest position; and in response to operating the latch cinch mechanism 50 and opening the latch mechanism 42, actuating the power cinch actuator 122 in the first direction and positioning the latch cinch mechanism in the rest position.

In one aspect of the method 1000, the ratchet 60 includes the lug 78 and the latch cinch mechanism 50 includes the ratchet lever 104 having the cinch cam 130 and the ice breaker cam 132, wherein the cinch cam 130 contacts the lug 78 in response to rotating the latch cinch mechanism 50 in the first direction and the ice breaker cam 132 contacts the lug 78 in response to rotating the latch cinch mechanism 50 in the second direction.

It will be appreciated that other methods may be utilized in accordance with the functionality of the system and its components described herein.

The present disclosure provides a unique configuration for utilizing a cinch latch mechanism within a closure latch assembly in a bi-directional arrangement for a power cinching operation in a first direction and power ice breaking operation in a second direction. A further benefit is that a remotely-located cinch assembly can be used in conjunction with the bi-directional power cinch/ice breaker function to eliminate the need to package a separate power actuator within the closure latch assembly for controlling actuation of the latch cinch mechanism, thereby allowing for modularity and packaging advantages. However, integration of a power cinch motor into the closure latch assembly to rotatably drive the dual-cam ratchet lever is also a contemplated alternative to the particular non-limiting embodiment disclosed. In summary, a rotatable cam driven by an electric motor acts in a first rotational direction to cinch the ratchet, and when the cam is rotated in the second rotational direction it acts to move the ratchet to its striker release position, thereby acting as an ice breaker. This arrangement can be used in both swing-type doors 16 (FIG. 2A) and sliding-type doors (FIG. 2B) and can further be configured to use the ice break function as a "presenter" function for causing the door to be moved to a slightly open presentment position relative to the vehicle body.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A power door for a motor vehicle closure system, the power door comprising:

a door moveable with respect to a vehicle body between an open position and a fully-closed position;

a closure latch assembly mounted to the door and having a latch mechanism, a latch release mechanism, and a latch cinch mechanism; and an actuator assembly mounted to the door and having a power actuator operatively connected to the latch cinch mechanism, wherein actuation of the power actuator in a first direction functions to cause the latch cinch mechanism to cinch the latch mechanism and actuation in a second direction functions to open the latch mechanism;

wherein the latch mechanism has a ratchet rotatable about a ratchet axis between a striker release position, whereat the ratchet is positioned to release a striker mounted to the vehicle body, and two distinct striker capture positions, whereat the ratchet is positioned to retain the striker, wherein the two distinct striker capture positions include a secondary striker capture position when the door is located in a partially-closed position and a primary striker capture position when the door is located in its fully-closed position, wherein the latch mechanism further comprises a ratchet biasing member for normally biasing the ratchet toward its striker release position, a pawl moveable between a ratchet holding position, whereat the pawl is positioned to hold the ratchet in its primary striker capture position, and a ratchet releasing position, whereat the pawl is located to permit rotation of the ratchet to its striker release position, and a pawl biasing member for normally biasing the pawl toward its ratchet holding position, wherein the latch release mechanism is operable to selectively move the pawl from its ratchet holding position to its ratchet releasing position, wherein the latch cinch mechanism is configured for rotation about a pivot axis different from the ratchet axis, the latch cinch mechanism including a rotatable ratchet lever having a cinch cam and an ice breaker cam, wherein the actuation of the power actuator in the first direction causes rotation of the ratchet lever about the pivot axis in a cinching direction for causing the cinch cam to engage the ratchet and forcibly rotate the ratchet from its secondary striker capture position into its primary striker capture position, thereby cinching the latch mechanism so as to provide a power cinch function, wherein the actuation of the power actuator in the second direction causes rotation of the ratchet lever about the pivot axis in an opening direction for causing the ice breaker cam to engage the ratchet and forcibly rotate the ratchet from its primary striker capture position to its striker release position, thereby opening the latch mechanism so as to provide a power opening function.

2. The power door of claim 1, wherein the ratchet lever is rotatable in the cinching direction from a rest position to a cinch-actuated position to provide the power cinch function, and wherein the ratchet lever is rotatable in the opening direction from the rest position to an ice break-actuated position to provide the power opening function.

3. The power door of claim 2, wherein the power actuator is operable to rotate the ratchet lever from its cinch-actuated position to its rest position upon completion of the power cinch function, and wherein the power actuator is operable to rotate the ratchet lever from its ice breaker-actuated position to its rest position upon completion of the power opening function.

4. The power door of claim 1, wherein the ratchet lever is fixed [for rotation] to a driven pulley for rotation about the pivot axis, wherein the latch cinch mechanism includes a drive pulley that is rotatably driven about the pivot axis by the power actuator, and wherein a cable assembly interconnects the driven pulley to the drive pulley.

5. A method for operating a power door for a motor vehicle closure system, the method comprising the steps of:

providing a closure latch assembly mounted to the power door, the closure latch assembly having a latch mechanism and a latch cinch mechanism, wherein the latch mechanism includes a ratchet rotatable about a ratchet axis between a striker release position, a secondary striker capture position, and a primary striker capture position;

providing a cinch assembly mounted to the door, the cinch assembly having a power actuator operatively connected to the latch cinch mechanism;

actuating the power actuator in a first direction and, in response thereto, causing the latch cinch mechanism to rotate in the first direction about a pivot axis different from the ratchet axis and cinching the latch mechanism;

actuating the power actuator in a second direction and, in response thereto, causing the latch cinch mechanism to rotate in the second direction about the pivot axis different from the ratchet axis and opening the latch mechanism;

receiving a striker in the latch mechanism of the closure latch assembly;

rotating the ratchet from the striker release position to the secondary striker capture position;

rotating the latch cinch mechanism in the first direction and, in response thereto, rotating the ratchet from the secondary striker capture position to the primary striker capture position;

rotating the latch cinch mechanism in the second direction and, in response thereto, rotating the ratchet from the primary striker capture position toward the striker release position; and rotating the ratchet to the striker release position.

6. The method of claim 5, wherein in response to the rotation of the ratchet from the striker release position to the secondary striker capture position, the method further comprises positioning a pawl of the latch mechanism to a first ratchet holding position against the ratchet to block rotation of the ratchet toward the striker release position;

in response to the rotation of the ratchet from the secondary striker capture position to the primary striker capture position, the method further comprises positioning the pawl in a second ratchet position to block rotation of the ratchet toward the striker release position;

and prior to the rotation of the latch cinch mechanism in the second direction, the method further comprises positioning the pawl in a ratchet releasing position to allow the ratchet to rotate toward the striker release position.

7. The method of claim 5, further comprising:

at a latch controller, receiving a first signal from one or more sensors indicating a door closing condition of the latch mechanism;

in response thereto, sending a first command from the latch controller to the power actuator to actuate the power actuator in the first direction;

at the latch controller, receiving a second signal from the one or more sensors indicating a door opening condition of the latch mechanism; and in response thereto, sending a second command from the latch controller to the power actuator to actuate the power actuator in the second direction.

8. The method of claim 7, wherein prior to receiving the first signal, the method further comprises rotating the ratchet of the latch mechanism from the striker release position to the secondary striker capture position and, in response thereto, positioning a pawl of the latch mechanism in a ratchet holding position;

in response to the actuation of the power actuator in the first direction, the method further comprises rotating the ratchet from the secondary striker capture position to the primary striker capture position;

prior to receiving the second signal, the method further comprises rotating the pawl to a ratchet releasing position; and in response to the actuation of the power actuator in the second direction, the method further comprises rotating the ratchet from the primary striker capture position toward the striker release position.

9. The method of claim 8, wherein the first signal includes a first pawl position signal and a first ratchet position signal indicating that the pawl is in the ratchet holding position and indicating that the ratchet is in the secondary striker capture position, and wherein the second signal includes a second pawl position signal and a second ratchet position signal indicating that the pawl is in the ratchet releasing position and that the ratchet is in the primary striker capture position.

10. The method of claim 5, wherein in response to the operation of the latch cinch mechanism and the cinching the latch mechanism, the method further comprises actuating the power actuator in the second direction and positioning the latch cinch mechanism in a rest position; and in response to the operation of the latch cinch mechanism and the opening of the latch mechanism, the method further comprises actuating the power actuator in the first direction and positioning the latch cinch mechanism in the rest position.

11. The method of claim 5, wherein the ratchet includes a lug and the latch cinch mechanism includes a ratchet lever having a cinch cam and an ice breaker cam, wherein the cinch cam contacts the lug in response to the rotation of the latch cinch mechanism in the first direction and the ice breaker cam contacts the lug in response to the rotation of the latch cinch mechanism in the second direction.

12. A system for operating a motor vehicle closure system, the system comprising:

a closure latch assembly having a latch mechanism and a latch cinch mechanism;

the latch mechanism including a ratchet rotatable about a ratchet axis in a first ratchet direction from a striker release position, to a secondary striker capture position, and to a primary striker capture position, and rotatable about the ratchet axis in a second ratchet direction opposite the first ratchet direction;

the latch mechanism including a pawl moveable between a ratchet holding position and a ratchet releasing position;

the latch cinch mechanism rotatable about a pivot axis different from the ratchet axis in a first direction, causing rotation of the ratchet in the first ratchet direction; and the latch cinch mechanism rotatable about the pivot axis in a second direction, causing rotation of the ratchet in the second ratchet direction, wherein the latch cinch mechanism includes a ratchet lever and the ratchet includes a lug, wherein the ratchet lever engages the lug to cause rotation of the ratchet in both the first and the second ratchet directions.

13. The system of claim 12, further comprising:

a power actuator operatively coupled to the latch cinch mechanism;

a controller in communication with the power actuator; and one or more sensors in communication with the controller;

wherein the controller is configured to send command signals to the power actuator in response to receiving signals from the one or more sensors indicating relative positions of the ratchet and pawl.

14. The system of claim 12, wherein the pawl is biased toward the ratchet holding position and the ratchet is biased toward the striker release position, wherein the pawl blocks the ratchet from rotation in the second ratchet direction when the pawl is in the ratchet holding position, wherein the pawl permits rotation of the ratchet in the second ratchet direction when the pawl is in the ratchet releasing position, and wherein the ratchet is rotatable in the first ratchet direction when the pawl is in both the ratchet holding position and the ratchet releasing position.

15. A method for operating a power door of a motor vehicle closure system, the method comprising the steps of:

providing a closure latch assembly mounted to the power door, the closure latch assembly having a latch mechanism and a latch cinch mechanism, wherein the latch mechanism includes a ratchet rotatable about a ratchet axis between a striker release position, a secondary striker capture position, and a primary striker capture position;

providing a cinch assembly mounted to the power door, the cinch assembly having a power actuator operatively connected to the latch cinch mechanism;

actuating the power actuator in a first direction for causing the latch cinch mechanism to rotate in a first direction about a pivot axis different from the ratchet axis and cinching the latch mechanism;

actuating the power actuator in a second direction for causing the latch cinch mechanism to rotate in the second direction about the pivot axis different from the ratchet axis and opening the latch mechanism;

at a latch controller, receiving a first signal from one or more sensors indicating a door closing condition of the latch mechanism;

sending a first command from the latch controller to the power actuator in response to the first signal to acuate the power actuator in the first direction;

at the latch controller, receiving a second signal from the one or more sensors indicating a door opening condition of the latch mechanism;

seconding a second command from the latch controller to the power actuator in response to the second signal to actuate the power actuator in the second direction;

prior to receiving the first signal, rotating the ratchet of the latch mechanism from the striker release position to the secondary striker capture position and, in response thereto, positioning a pawl of the latch mechanism in a ratchet holding position;

in response to the actuation of the power actuator in the first direction, rotating the ratchet from the secondary striker capture position to the primary striker capture position;

prior to receiving the second signal, rotating the pawl to a ratchet releasing position; and in response to the actuation of the power actuator in the second direction, rotating the ratchet from the primary striker capture position toward the striker release position.

16. The method of claim 15 further comprising the steps of:

receiving a striker in the latch mechanism of the closure latch assembly;

rotating the ratchet from the striker release position to the secondary striker capture position;

rotating the latch cinch mechanism in the first direction and, in response thereto, rotating the ratchet from the secondary striker capture position to the primary striker capture position; and rotating the latch cinch mechanism in the second direction and, in response thereto, rotating the ratchet from the primary striker capture position toward the striker release position.

17. The method of claim 15 wherein the first signal includes a first pawl position signal and a first ratchet position signal indicating that the pawl is in the ratchet holding position and indicating that the ratchet is in the secondary striker capture position, and wherein the second signal includes a second pawl position signal and a second ratchet position signal indicating that the pawl is in the ratchet holding position and the ratchet is in the primary striker capture position.

* * * * *